US009984602B2

(12) United States Patent
Koito et al.

(10) Patent No.: US 9,984,602 B2
(45) Date of Patent: May 29, 2018

(54) DECORATIVE ILLUMINATION RECORDING SHEET, METHOD OF PREPARING THE SAME, DECORATIVE ILLUMINATION IMAGE SHEET, METHOD OF PREPARING THE SAME, AND DECORATIVE ILLUMINATION SIGNBOARD

(71) Applicant: FUJIFILM CORPORATION, Minato-ku, Tokyo (JP)

(72) Inventors: Naoki Koito, Shizuoka (JP); Toshiaki Hayashi, Shizuoka (JP); Miyoko Hara, Shizuoka (JP)

(73) Assignee: FUJIFILM CORPORATION, Tokyo (JP)

( * ) Notice: Subject to any disclaimer, the term of this patent is extended or adjusted under 35 U.S.C. 154(b) by 0 days. days.

(21) Appl. No.: 15/677,044

(22) Filed: Aug. 15, 2017

(65) Prior Publication Data

US 2017/0365199 A1 Dec. 21, 2017

Related U.S. Application Data

(63) Continuation of application No. PCT/JP2016/054721, filed on Feb. 18, 2016.

(30) Foreign Application Priority Data

Mar. 24, 2015 (JP) ..... 2015-061707

(51) Int. Cl.
*G09F 13/04* (2006.01)
*B41J 2/01* (2006.01)
(Continued)

(52) U.S. Cl.
CPC ..... *G09F 13/04* (2013.01); *B41J 2/01* (2013.01); *B41J 3/407* (2013.01); *B41M 5/502* (2013.01)

(58) Field of Classification Search
CPC .. G09F 13/04; B41J 2/01; B41J 3/407; B41M 5/502
See application file for complete search history.

(56) References Cited

U.S. PATENT DOCUMENTS 6,605,337 B1 * 8/2003 Mori ..... B41M 3/008 428/195.1
2003/0231237 A1 12/2003 Nagaike et al.
2017/0365199 A1 * 12/2017 Koito ..... G09F 13/04

FOREIGN PATENT DOCUMENTS

JP H06-281802 A 10/1994
JP 2004-009676 A 1/2004
(Continued)

OTHER PUBLICATIONS

International Search Report issued in International Application No. PCT/JP2016/054721 dated Apr. 12, 2016.
(Continued)

*Primary Examiner* — Betelhem Shewareged
(74) *Attorney, Agent, or Firm* — Solaris Intellectual Property Group, PLLC

(57) ABSTRACT

A decorative illumination recording sheet that includes: a resin base; and a white layer that is disposed on the resin base and contains a white pigment and a binder, in which a colorant different from the white pigment is contained, and in a case where an average transmittance in a wavelength range of 400 nm to 700 nm is represented by Tv and an average transmittance in a wavelength range exceeding 700 nm, but not exceeding 800 nm is represented by Tr, Tv and Tr satisfy relationships expressed by the following Formulae (1) and (2), a method of manufacturing the decorative illumination recording sheet, a decorative illumination image sheet, a method of manufacturing the decorative illumination image sheet, and a decorative illumination signboard.

$$40.0\% \leq Tv < 50.0\% \quad (1)$$

$$40.0\% \leq Tr < 50.0\% \quad (2)$$

16 Claims, 2 Drawing Sheets

(51) Int. Cl.
*B41M 5/50* (2006.01)
*B41J 3/407* (2006.01)

(56) References Cited

FOREIGN PATENT DOCUMENTS

| | | | |
|---|---|---|---|
| JP | 2014-144578 | A | 8/2014 |
| WO | 2010/079765 | A1 | 7/2010 |

OTHER PUBLICATIONS

Written Opinion of the ISA issued in International Application No. PCT/JP2016/054721 dated Apr. 12, 2016.

* cited by examiner

DECORATIVE ILLUMINATION RECORDING SHEET, METHOD OF PREPARING THE SAME, DECORATIVE ILLUMINATION IMAGE SHEET, METHOD OF PREPARING THE SAME, AND DECORATIVE ILLUMINATION SIGNBOARD

CROSS-REFERENCE TO RELATED APPLICATIONS

This application is a continuation application of International Application No. PCT/JP2016/054721, filed Feb. 18, 2016, the disclosure of which is incorporated herein by reference in its entirety. Further, this application claims priority from Japanese Patent Application No. 2015-061707, filed Mar. 24, 2015, the disclosure of which is incorporated herein by reference in its entirety.

BACKGROUND OF THE INVENTION

1. Field of the Invention

The present invention relates to a decorative illumination recording sheet, a method of preparing the decorative illumination recording sheet, a decorative illumination image sheet, a method of preparing the decorative illumination image sheet, and a decorative illumination signboard.

2. Description of the Related Art

Decorative illumination signboards that have been widely used in recent years are provided with a light source and a decorative illumination image sheet having a decorative illumination image. Decorative illumination signboards are used in various advertisements, labels, maps, and the like.

Decorative illumination signboards are signboards that are seen as a transmission image by light from a backlight light source at night without sunlight. These are used to be attached to, for example, a store window, a station passage, a building wall, or the like.

In a case where a decorative illumination image sheet is produced, a decorative illumination recording sheet is used as a recording medium. In general, decorative illumination signboards are installed outdoors. Accordingly, a decorative illumination recording sheet having an ink-receiving recording layer disposed on a resin base having excellent water resistance is used.

As the decorative illumination recording sheet, a decorative illumination recording sheet is proposed in which the adhesiveness of an ink composition applied through an ink jet recording method is improved due to a specific binder resin and a specific cross-linking agent contained in an ink-receiving recording layer (for example, JP2014-144578A).

As a light source of a decorative illumination signboard, a fluorescent lamp has been used in many cases. In recent years, a white LED obtaining white light using light emitting diodes (hereinafter, may be referred to as "LED") has been used as a light source to lower the power consumption and increase the lifetime of the light source. In a general white LED lamp, a combination of a blue LED and a yellow fluorescent body serves as a light source that emits white light. Therefore, a decorative illumination signboard using a white LED light source as a light source has a problem in that a decorative illumination image appears pale.

In order to solve the problem that a decorative illumination image appears pale, a decorative illumination recording sheet is proposed in which a layer containing a yellow pigment is formed on a surface of a resin base and a total light transmittance of the decorative illumination recording sheet is adjusted within a specific range (for example, see WO2010/079765A).

SUMMARY OF THE INVENTION

A white LED has a different light emitting wavelength from that of a fluorescent lamp, and its light emitting spectrum is confirmed up to the long wavelength side. For example, in a case of a three-wavelength emission-type fluorescent lamp, the light emission at a wavelength of 680 nm or greater is almost not confirmed. Meanwhile, in a case of a general white LED lamp that is currently used, the light emission on the long wavelength side exceeding a wavelength of 700 nm is also confirmed. In addition, in a case of a white LED intended to obtain good color rendering properties, the above-described tendency that the light emission is confirmed on the long wavelength side is more noticeable. In addition, since a white LED is a group of point light sources, a direct backlight-type decorative illumination signboard has a problem in that due to a specialized light source configuration, a light source image is visually confirmed through a decorative illumination image.

According to the examination of the inventors, a new problem has been found in which in a case where a white LED light source is used as a light source of a decorative illumination signboard and a white layer that is a light scattering layer is provided on a surface of a resin base, a light source image is easy to see in an annular shape through a decorative illumination image.

In a case where a decorative illumination recording sheet provided with a layer containing a yellow pigment described in WO2010/079765A is used, the paleness of the white LED light source can be relieved, but show-through of the light source image is not suppressed.

In order to suppress the visual confirmation of an LED light source image through a decorative illumination image, for example, the white layer as a light scattering layer is considered to be made thicker to increase a contrast ratio. However, in a case where the white layer is made thicker, there is a problem in that the visible light transmittance is reduced, the brightness of the decorative illumination image is reduced, and thus the quality as a decorative illumination signboard cannot be sufficiently obtained. Accordingly, it is difficult to satisfy both of the prevention of show-through of the LED light source image in the decorative illumination signboard and the brightness of the decorative illumination image in the decorative illumination signboard.

An object of an embodiment is to provide a decorative illumination recording sheet in which both of the prevention of show-through of an LED light source image in the decorative illumination recording sheet using an LED light source and the brightness of a display image in a case where a decorative illumination signboard is formed and a decorative illumination image is displayed are satisfied, and a method of preparing the decorative illumination recording sheet.

Another object of the embodiment is to provide a decorative illumination image sheet in which a display image is bright and has excellent image quality, a method of preparing the decorative illumination image sheet, and a decorative illumination signboard.

Means for achieving the objects includes the following embodiments.

<1> A decorative illumination recording sheet comprising: a resin base; and a white layer that is disposed on the resin base and contains a white pigment and a binder, in which a colorant different from the white pigment is contained, and in a case where an average transmittance in a wavelength range of 400 nm to 700 nm is represented by Tv and an average transmittance in a wavelength range exceeding 700 nm, but not exceeding 800 nm is represented by Tr, Tv and Tr satisfy relationships expressed by Formulae (1) and (2).

$$40.0\% \leq Tv < 50.0\% \quad (1)$$

$$40.0\% \leq Tr < 50.0\% \quad (2)$$

<2> The decorative illumination recording sheet according to <1>, in which the colorant different from the white pigment is contained in the white layer.

<3> The decorative illumination recording sheet according to <1> or <2>, in which the content of the colorant different from the white pigment in the decorative illumination recording sheet is 0.5 $mg/m^2$ or greater and less than 50.0 $mg/m^2$.

<4> The decorative illumination recording sheet according to any one of <1> to <3>, in which the content of the colorant different from the white pigment in the decorative illumination recording sheet is 1.0 $mg/m^2$ or greater and less than 10.0 $mg/m^2$.

<5> The decorative illumination recording sheet according to any one of <1> to <4>, in which the colorant different from the white pigment includes at least one colorant selected from the group consisting of a phthalocyanine pigment, a dioxazine pigment, and a cobalt oxide pigment.

<6> The decorative illumination recording sheet according to any one of <1> to <5>, in which the binder contained in the white layer includes at least one selected from the group consisting of a polyolefin resin, a polyester resin, and an acrylic resin.

<7> The decorative illumination recording sheet according to any one of <1> to <6>, in which the white layer has a thickness of 0.5 μm or greater and less than 10 μm.

<8> The decorative illumination recording sheet according to any one of <1> to <7>, that is for ink jet recording.

<9> The decorative illumination recording sheet according to any one of <1> to <8>, further comprising: an ink accepting layer on the white layer disposed on the resin base.

<10> A method of preparing a decorative illumination image sheet comprising: an ink application step of applying an ink composition to a surface of the decorative illumination recording sheet according to any one of <1> to <9>.

<11> The method of preparing a decorative illumination image sheet according to <10>, in which the ink composition is a radiation-curable ink composition, the ink application step is a step of discharging the radiation-curable ink composition to the surface of the decorative illumination recording sheet through an ink jet method, and a curing step of curing the radiation-curable ink composition by irradiating the discharged radiation-curable ink composition with radiation is further provided.

<12> A decorative illumination image sheet comprising: the decorative illumination recording sheet according to any one of <1> to <9>; and an ink image.

<13> A decorative illumination signboard comprising: a light emitting diode (LED) light source; and the decorative illumination image sheet according to <12>.

<14> A method of preparing a decorative illumination recording sheet comprising: forming a white layer by applying a white layer-forming coating liquid containing a white pigment and a binder to at least one side of a resin base; and adjusting, in a case where an average transmittance in a wavelength range of 400 nm to 700 nm is represented by Tv and an average transmittance in a wavelength range exceeding 700 nm, but not exceeding 800 nm is represented by Tr, Tv and Tr within a range satisfying relationships expressed by Formulae (1) and (2) using a colorant different from the white pigment.

$$40.0\% \leq Tv < 50.0\% \quad (1)$$

$$40.0\% \leq Tr < 50.0\% \quad (2)$$

<15> The method of preparing a decorative illumination recording sheet according to <14>, further comprising: a step of forming an ink accepting layer by applying an ink accepting layer-forming coating liquid to the white layer.

<16> The method of preparing a decorative illumination recording sheet according to <14> or <15>, in which the forming of the white layer includes the adjusting of Tv and Tr within a range satisfying the relationships expressed by Formulae (1) and (2), and in the forming of the white layer by applying a white layer-forming coating liquid containing a white pigment and a binder to at least one side of a resin base, a white layer-forming coating liquid containing a white pigment, a binder, and a colorant different from the white pigment is applied to form the white layer, and thus Tv and Tr of the decorative illumination recording sheet are adjusted within a range satisfying the relationships expressed by Formulae (1) and (2).

According to an embodiment of the invention, a decorative illumination recording sheet in which both of the prevention of show-through of an LED light source image in the decorative illumination recording sheet using an LED light source and the brightness of a display image in a case where a decorative illumination signboard is formed and a decorative illumination image is displayed are satisfied, and a method of preparing the decorative illumination recording sheet are provided.

According to another embodiment, a decorative illumination image sheet in which a display image is bright and has excellent image quality, a method of preparing the decorative illumination image sheet, and a decorative illumination signboard are provided.

DESCRIPTION OF THE PREFERRED EMBODIMENTS

Figure 1:
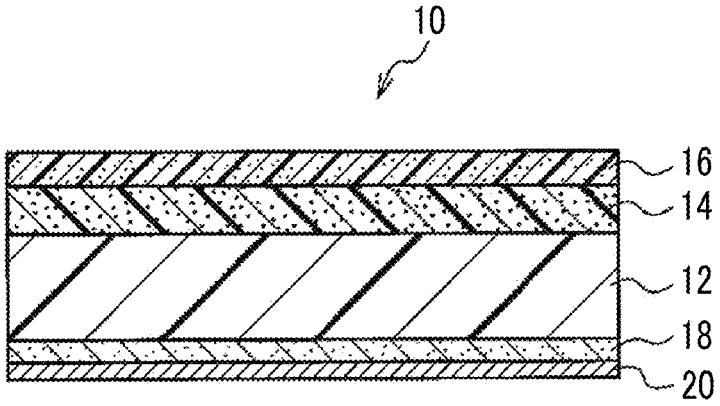
FIG. 1 is a schematic cross-sectional view of a decorative illumination recording sheet according to an aspect of the invention.

Hereinafter, the invention will be described in detail using embodiments. The following description of constituent requirements will be given based on a representative embodiment of the invention, but the invention is not limited to the representative embodiment.

In the present specification, "show-through of the LED light source image" includes a case in which in a decorative illumination signboard, in a case where an LED light source is turned on, the brightness unevenness of a decorative illumination image resulting from the existence of an LED light source image is visually confirmed through a decorative illumination image sheet, and a case in which an LED light source image is visually confirmed as a light spot or an annular light source image.

In the present specification, the numerical value range expressed using " . . . to . . . " refers to a numerical value range including the numerical values described before and after " . . . to . . . " as a lower limit value and an upper limit value.

In the present specification, the term "step" includes not only an independent step but also a step that is not clearly distinguished from other steps as long as the desired object of the step can be achieved.

In the present specification, in a case where more than one substance exists corresponding to each component in a composition, the amount of each component in the composition means a total amount of the substances existing in the composition, unless otherwise specified.

In the present specification, the term "(meth)acrylic" may be used for a case of expressing at least either "acrylic" or "methacrylic".

<<Decorative Illumination Recording Sheet>>

A decorative illumination recording sheet according to an embodiment has a resin base and a white layer disposed on the resin base and containing a white pigment and a binder, and contains a colorant different from the white pigment. The decorative illumination recording sheet is a decorative illumination recording sheet in which in a case where an average transmittance in a wavelength range of 400 nm to 700 nm is represented by Tv and an average transmittance in a wavelength range exceeding 700 nm, but not exceeding 800 nm is represented by Tr, Tv and Tr satisfy the relationships expressed by Formulae (1) and (2).

$$40.0\% \leq Tv < 50.0\% \quad (1)$$

$$40.0\% \leq Tr < 50.0\% \quad (2)$$

The decorative illumination recording sheet according to the present embodiment has at least a resin base and a white layer containing a white pigment and a binder, and may have a layer other than the white layer if desired.

The expression "has a white layer on the resin base" means that the white layer is provided on at least one surface of the resin base of the decorative illumination recording sheet, and does not essentially mean that the resin base and the white layer are provided adjacent to each other. Accordingly, in the present specification, the expression "has a white layer on the resin base" includes an aspect in which a layer is further provided between the resin base and the white layer. In addition, the expression that the decorative illumination recording sheet "contains a colorant different from the white pigment" means that any of the resin base, the white layer, and an arbitrary layer provided if desired, that are included in the decorative illumination recording sheet, contains a colorant different from the white pigment.

The action of the present embodiment is not clear, but presumed as follows.

The decorative illumination recording sheet according to the present embodiment has a white layer containing a white pigment and a binder, and contains a colorant different from the white pigment contained in the white layer. Accordingly, since the light from an LED light source is more effectively absorbed than in an aspect in which a white pigment is contained individually, the transmittance on the long wavelength side is suppressed. Thus, an effect of suppressing the transmittance on the long wavelength side as in a case where the content of the white pigment is increased is obtained, but the reduction in the transmittance of visible light is suppressed.

It is thought that in a case where the contents of the white pigment and the colorant different from the white pigment are controlled, the relationships expressed by $40.0\% \leq Tv < 50.0\%$: Formula (1) and $40.0\% \leq Tr < 50.0\%$: Formula (2) can be satisfied where Tv represents an average transmittance in a wavelength range of 400 nm to 700 nm and Tr represents an average transmittance in a wavelength range exceeding 700 nm, but not exceeding 800 nm, and thus both of the prevention of show-through of an LED light source image and the brightness of a display image formed in a decorative illumination signboard are satisfied.

In a preferable aspect of the present embodiment, in a case in which the white pigment and the colorant different from the white pigment are contained in the same layer, the colorant different from the white pigment has a synergistic effect with light reflection and light scattering by the white pigment adjacent thereto, and thus an effect that is exhibited because the colorant is contained is more significantly observed. Accordingly, it is thought that the desired effect is obtained even in a case where the content of the colorant different from the white pigment is reduced as compared with a case where the colorant is contained in a layer different from the white layer.

The present embodiment is not restricted to the presumed mechanism described above.

FIG. 1 is a schematic cross-sectional view illustrating a configuration of a decorative illumination recording sheet according to an aspect of the invention. A decorative illumination recording sheet 10 illustrated in FIG. 1 has, on one surface of a resin base 12, a white layer 14 containing a white pigment and a binder and an ink accepting layer 16 in this order from the side closer to the resin base 12. The ink accepting layer 16 is a layer that can improve adhesiveness between the decorative illumination recording sheet and an ink composition in a case where a decorative illumination image, that is, an ink image is formed using the ink composition on the decorative illumination recording sheet. The decorative illumination recording sheet that is used in a case where a decorative illumination image is formed using an ink jet recording method preferably has an ink accepting layer.

On a surface of the resin base 12 on a side opposite to the side on which the white layer 14 is provided, an antistatic layer 18 and a hard coat layer 20 are provided in this order from the side closer to the resin base 12.

Hereinafter, the decorative illumination recording sheet 10 according to the present embodiment will be described in detail using the preferable aspect illustrated in FIG. 1 as an example.

In the decorative illumination recording sheet according to the present embodiment, in a case where an average transmittance in a wavelength range of 400 nm to 700 nm is represented by Tv and an average transmittance in a wavelength range exceeding 700 nm, but not exceeding 800 nm is represented by Tr, Tv and Tr satisfy the relationships expressed by Formulae (1) and (2).

$$40.0\% \leq Tv < 50.0\% \quad (1)$$

$$40.0\% \leq Tr < 50.0\% \quad (2)$$

That is, it has been found that both of the prevention of show-through of an LED light source image and the brightness of a decorative illumination signboard using the decorative illumination recording sheet are satisfied in a case where both of the average transmittance (Tv) in a wavelength range of 400 nm to 700 nm that corresponds to a visible range and the average transmittance (Tr) in a longer wavelength range exceeding 700 nm, but not exceeding 800 nm are within the range of 40.0% or greater and less than 50.0%.

The average transmittance (Tv) in the decorative illumination recording sheet 10 according to the present embodiment is 40.0% or greater and less than 50.0%, and preferably 42.0% or greater and less than 50.0%.

The average transmittance (Tr) in the decorative illumination recording sheet 10 according to the present embodiment is 40.0% or greater and less than 50.0%, and preferably 40.0% to 48.0%.

In the decorative illumination recording sheet 10, the transmittance of light of each wavelength, the average transmittance (Tv) in a wavelength range of 400 nm to 700 nm, and the average transmittance (Tr) in a wavelength range exceeding 700 nm, but not exceeding 800 nm can be measured using a spectrophotometer, e.g., an ultraviolet-visible-near-infrared (UV-Vis-NIR) spectrophotometer. Examples of commercially available products that can be used in the measurement of the transmittance in the present embodiment include a spectrophotometer V-560 (manufactured by JASCO Corporation). The present specification discloses values of transmittances measured using a spectrophotometer V-560 that is a commercially available product.

Figure 2:
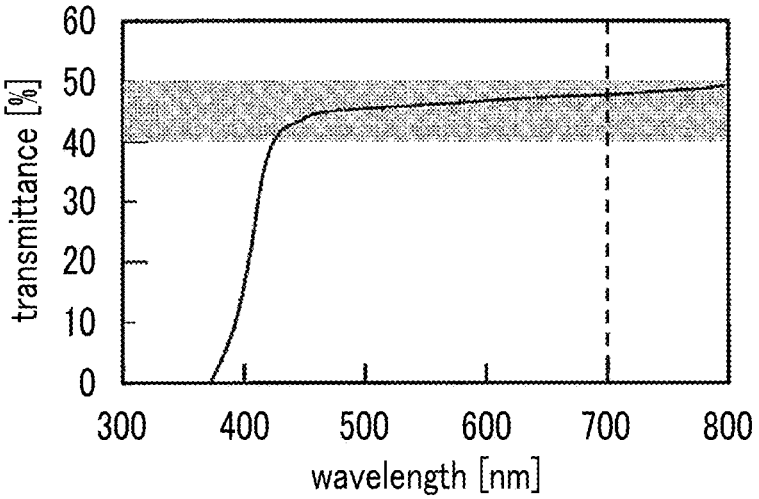
FIG. 2 is a model diagram illustrating a suitable aspect of a graph of a transmittance of a decorative illumination recording sheet according to an embodiment at the entire measurement wavelengths.

FIG. 2 is a model diagram illustrating a graph of a transmittance of the decorative illumination recording sheet according to the present embodiment at the entire measurement wavelengths. The expression that the average transmittance (Tv) in a wavelength range of 400 nm to 700 nm and the average transmittance (Tr) in a wavelength range exceeding 700 nm, but not exceeding 800 nm satisfy the relationships expressed by Formulae (1) and (2) means that as schematically illustrated in the graph in FIG. 2, an excellent transmittance is shown on the short wavelength side of visible light, and in a center wavelength range of visible light, a transmittance at which the transmission of light in a long wavelength range related to the transmission of an LED light source is appropriately suppressed while an appropriate visible light transmittance is maintained at which an excellent balance is achieved between shieldability and transmittance. The region shown by halftone dots in FIG. 2 is a region where the average transmittance is 40.0% to 50.0%, and it can be said that the transmittance of the decorative illumination recording sheet according to the present embodiment at the entire measurement wavelengths is preferably approximate to the spectrum shown as a model diagram in FIG. 2 to satisfy the relationships expressed by Formulae (1) and (2).

The method of adjusting the average transmittance (Tv) and the average transmittance (Tr) in the decorative illumination recording sheet 10 according to the present embodiment within a range of 40.0% or greater and less than 50.0% is not particularly limited. Examples of the method of adjusting the average transmittance (Tv) and the average transmittance (Tr) include a method of adjusting the type, content, dispersion particle diameter, and the like of the white pigment contained in the white layer 14 of the decorative illumination recording sheet 10, a method of adjusting the type, content, dispersion particle diameter, and the like of the colorant, a method of selecting a colorant-containing region, and a method of adjusting the type and content of the binder. More than one selected from the above-described average transmittance adjusting methods may be performed in combination.

<White Layer>

The white layer 14 contains at least a white pigment and a binder.

[White Pigment]

The white pigment contained in the white layer 14 is not particularly limited. Any white pigment can be used in the present embodiment as long as it can scatter light at a wavelength of 400 nm to 800 nm.

In view of obtaining a clear decorative illumination image, the white pigment is preferably at least one inorganic pigment selected from the group consisting of titanium oxide, silica, calcium carbonate, talc, zeolite, alumina, barium sulfate, and kaolinite. Among these, a rutile-type titanium oxide called a titanium white is preferable as the white pigment from the viewpoint that it has a more excellent performance of reflecting light having a wavelength in a visible range.

Regarding the particle diameter of the white pigment contained in the white layer 14, the average primary particle diameter is preferably in a range of 0.1 μm to 10 μm, and more preferably in a range of 0.2 μm to 1 μm from the viewpoint of the balance between the light scattering properties and the transmittance.

The average primary particle diameter of the white pigment can be measured based on a photograph of the white pigment taken by a scanning electron microscope (SEM). In the present specification, projected area equivalent circle diameters of 50 white pigment particles in the photograph of the white pigment are obtained based on the photograph of the white pigment taken by a scanning electron microscope (SEM: 50,000 magnifications), and a calculated average value is employed as a value of the average primary particle diameter.

In the white layer, the content of the white pigment is preferably in a range of 1.0 $g/m^2$ to 10.0 $g/m^2$, more preferably in a range of 1.5 $g/m^2$ to 5.0 $g/m^2$, and even more preferably in a range of 2.0 $g/m^2$ to 3.0 $g/m^2$ from the viewpoint of good quality of a decorative illumination image.

[Binder]

The white layer 14 contains a binder. The binder is used to hold the white pigment and to form the white layer.

As the binder, a film-forming resin can be used without particular limitation. Examples of the resin that can be used as the binder of the white layer (hereinafter, may be referred to as a binder resin) include a polyolefin resin, a polyester resin, an acrylic resin, and a urethane resin. The binder resin is preferably a water-soluble or water-dispersible resin in view of less environmental load. Among these, the binder preferably includes at least one selected from the group consisting of a polyolefin resin, a polyester resin, and an acrylic resin from the viewpoint of good hardness and a good transmittance of the white layer to be formed, and more preferably includes an acrylic resin in view of the fact that the acrylic resin has higher stability to light than other resins.

Hereinafter, the binder that can be used in the white layer will be described.

(Acrylic Resin)

The acrylic resin according to the present embodiment is a resin including, as a polymerization component, a monomer having at least one selected from an acryloyl group and a methacryloyl group, and is preferably a resin in which in a case where a total mass of the acrylic resin is 100 mass %, a total mass of a repeating unit formed by polymerizing a monomer having at least one selected from an acryloyl group and a methacryloyl group is greater than 50 mass %. Here, the monomer having at least one selected from an acryloyl group and a methacryloyl group will be appropriately referred to as "(meth)acrylic monomer".

The acrylic resin is obtained by homopolymerizing a (meth)acrylic monomer or copolymerizing a (meth)acrylic monomer with other monomers.

In a case where the acrylic resin is a copolymer of a (meth)acrylic monomer and other monomers, other monomers to be copolymerized with the (meth)acrylic monomer may be a monomer having a carbon-carbon double bond or a monomer having an ester bond or a urethane bond.

The copolymer of a (meth)acrylic monomer and other monomers may be any one of a random copolymer, a block copolymer, and a graft copolymer.

The acrylic resin according to the present embodiment includes a mixture that is a polymer obtained by homopolymerizing a (meth)acrylic monomer or copolymerizing a (meth)acrylic monomer with other monomers in a solution or dispersion liquid of a polymer other than the acrylic resin, and includes other polymers such as a polyester resin and a urethane resin. Examples of the polymer obtained by homopolymerizing a (meth)acrylic monomer or copolymerizing a (meth)acrylic monomer with other monomers in a solution or dispersion liquid of a polymer other than the acrylic resin include a polymer obtained by homopolymerizing a (meth)acrylic monomer or copolymerizing a (meth) acrylic monomer with other monomers in a polyester solution or a polyester dispersion liquid and a polymer obtained by homopolymerizing a (meth)acrylic monomer or copolymerizing a (meth)acrylic monomer with other monomers in a polyurethane solution or a polyurethane dispersion liquid.

The acrylic resin may have at least one selected from a hydroxyl group and an amino group in order to further improve adhesiveness between the white layer and a layer adjacent thereto, e.g., adhesiveness between the white layer and a layer such as the resin base and the ink accepting layer.

Specific examples of the (meth)acrylic monomer that can be used in the synthesis of the acrylic resin are not particularly limited. Representative examples of the (meth)acrylic monomer include (meth)acrylic acids; hydroxyalkyl (meth) acrylates such as 2-hydroxyethyl (meth)acrylate, 2-hydroxypropyl (meth)acrylate, and 4-hydroxybutyl (meth)acrylate; alkyl (meth)acrylates such as methyl (meth)acrylate, ethyl (meth)acrylate, propyl (meth)acrylate, butyl (meth)acrylate, and lauryl (meth)acrylate; (meth)acrylamides; N-substituted acrylamides such as diacetone acrylamide and N-methylol acrylamide; (meth)acrylonitriles; and silicon-containing (meth)acrylic monomers such as γ-methacryloxy propyl trimethoxysilane.

A commercially available product may be used as the acrylic resin. Examples of commercially available products of the acrylic resin that can be used in the white layer include JURYMER (registered trademark) ET-410 (manufactured by TOAGOSEI CO., LTD.) and AS-563A (trade name: manufactured by DAICEL FINECHEM LTD.).

(Polyolefin Resin)

The polyolefin resin that can be used in the white layer is a polymer that is obtained by polymerizing, as a starting material, an alkene such as ethylene, butylene, and propylene. It may be a polymer including only an alkene as a polymerization component, or a copolymer including an alkene and a polymerizable monomer other than the alkene as polymerization components.

The polyolefin resin is preferably a resin in which in a case where a total mass of the polyolefin resin is 100 mass %, a total mass of a repeating unit formed by polymerizing an alkene (hereinafter, may be referred to as "repeating unit derived from an alkene") is greater than 50 mass %.

Examples of the copolymer that can be included in the polyolefin resin and includes a repeating unit derived from an alkene and a repeating unit other than the repeating unit derived from an alkene include the following copolymers.

Copolymers including: as polymerization components, an alkene selected from ethylene and propylene; and an acrylic monomer other than an acrylic acid or a methacrylic monomer other than a methacrylic acid Copolymers including: as polymerization components, an alkene selected from ethylene and propylene; and an unsaturated carboxylic acid (including anhydride thereof)

Ternary copolymers including: as polymerization components, an alkene selected from ethylene and propylene; an acrylic monomer other than an acrylic acid or a methacrylic monomer other than a methacrylic acid; and an unsaturated carboxylic acid (including anhydride thereof)

Preferable examples of the acrylic monomer other than an acrylic acid and the methacrylic monomer other than a methacrylic acid include methyl methacrylate, ethyl acrylate, butyl acrylate, and 2-hydroxyethyl acrylate.

Preferable examples of the unsaturated carboxylic acid include acrylic acid, methacrylic acid, itaconic acid, maleic acid, and maleic acid anhydride.

The polymerizable monomers other than an alkene that can be included in the polyolefin resin copolymer may be used alone or in combination of two or more types thereof.

The weight-average molecular weight of the polyolefin resin is preferably 2,000 to 200,000. The polyolefin resin may have a linear structure or a branched structure.

The polyolefin resin is preferably used as an aqueous dispersion called latex. As a method of preparing an aqueous dispersion of a polyolefin resin, a method using emulsification and a method using emulsification and dispersion are used, and the former is preferable. Regarding the specific method thereof, for example, the method described in JP3699935B can be referred to.

In a case where the polyolefin resin has a form of an aqueous dispersion, the polyolefin resin preferably has a hydrophilic functional group such as a carboxyl group and a hydroxyl group. In a case where the polyolefin resin has a form of an aqueous dispersion, it may contain an emulsion stabilizer such as a surfactant (example: anionic or nonionic surfactant) and a polymer (example: polyvinyl alcohol) in order to improve stability. If necessary, compounds known as a latex additive such as a pH adjusting agent (example: ammonia, triethylamine, sodium hydrogen carbonate), a preservative (example: 1,3,5-hexahydro-(2-hydroxyethyl)-s-triazine, 2-(4-thiazolyl)benzimidazole), a thickener (example: sodium polyacrylate, methyl cellulose), and a film formation assistant (example: butyl carbitol acetate) may be added thereto.

The polyolefin resin is commercially available, and commercially available products exemplified below can be used as a binder.

Examples of commercially available products of the polyolefin resin that can be used as a binder include BONDINE HX-8210, HX-8290, TL-8030, LX-4110 (trade name, all manufactured by Sumitomo Chemical Co., Ltd.), ARROWBASE (registered trademark) SA-1200, ARROWBASE SB-1010, ARROWBASE SE-1013N, and ARROWBASE SE-1200 (trade name, all manufactured by UNITIKA LTD.).

(Polyester Resin)

The polyester resin is a general term for polymers whose main chain has an ester bond. In general, it is a product obtained by a reaction between a dicarboxylic acid and a polyol.

Examples of the dicarboxylic acid that can be used in the synthesis of the polyester resin include fumaric acid, itaconic acid, adipic acid, sebacic acid, terephthalic acid, isophthalic acid, sulfoisophthalic acid, and naphthalene dicarboxylic acid.

Examples of the polyol that can be used in the synthesis of the polyester resin include ethylene glycol, propylene glycol, glycerin, hexanetriol, butanediol, hexanediol, and 1,4-cyclohexanedimethanol.

A polyester resin and the raw material thereof are described in, for example, "Handbook of Polyester Resin" (written by Eiichiro Takiyama, NIKKAN KOGYO SHIMBUN, LTD., published in 1988).

Examples of the polyester resin include a polyester resin selected from a polyhydroxy butyrate (PHB) resin, a polycaprolactone (PCL) resin, a polycaprolactone butylene succinate resin, a polybutylene succinate (PBS) resin, a polybutylene succinate adipate (PBSA) resin, a polybutylene succinate carbonate resin, a polyethylene terephthalate succinate resin, a polybutylene adipate terephthalate resin, a polytetramethylene adipate terephthalate resin, a polybutylene adipate terephthalate resin, a polyethylene succinate (PES) resin, a polyglycolic acid (PGA) resin, and a polylactic acid (PLA) resin, a carbonate copolymer of aliphatic polyester, and a copolymer of aliphatic polyester and polyamide.

A commercially available product may be used as the polyester resin as a binder. Examples of commercially available products include FINETEX (registered trademark) ES650, ES2200 (all manufactured by DIC Corporation), VYLONAL (registered trademark) MD1245, VYLONAL MD1400, VYLONAL MD1480 (all manufactured by TOYOBO CO., LTD.), PESUREJIN (registered trademark) A-110, A-124GP, A-520, A-640 (all manufactured by TAKAMATSU OIL & FAT CO., LTD.), PLASCOAT (registered trademark) Z502, Z561, Z730, Z687, and Z592 (all manufactured by GOO CHEMICAL CO., LTD.).

(Polyurethane Resin)

The polyurethane resin is a general term for polymers whose main chain has a urethane bond. In general, it is a product obtained by a reaction between a diisocyanate and a polyol.

Examples of the diisocyanate that can be used in the synthesis of the polyurethane resin include toluene diisocyanate (TDI), diphenylmethane diisocyanate (MDI), naphthalene diisocyanate (NDI), tolidine diisocyanate (TODI), hexamethylene diisocyanate (HDI), and isophorone diisocyanate (IPDI).

Examples of the polyol that can be used in the synthesis of the polyurethane resin include ethylene glycol, propylene glycol, glycerin, and hexanetriol.

As the binder of the white layer, in addition to a general polyurethane resin, a polyurethane resin in which the molecular weight is increased by performing a chain extension treatment on a polyurethane resin obtained by a reaction between a diisocyanate and a polyol can be used.

The diisocyanates, polyols, and chain extension treatment described related to the polyurethane resin are described in detail in, for example, "Handbook of Polyurethane" (edited by Keiji Iwata, NIKKAN KOGYO SHIMBUN, LTD., published in 1987). The description concerning the polyurethane resin and the raw material thereof described in "Handbook of Polyurethane" can be applied to the present specification according to the purpose.

A commercially available product may be used as the polyurethane resin as a binder. Examples of commercially available products include SUPERFLEX (registered trademark) 470, 210, 150HS, 150HF, ELASTRON (registered trademark) H-3 (all manufactured by DKS Co., Ltd.), HYDRAN (registered trademark) AP-20, AP-40F, WLS-210 (all manufactured by DIC Corporation), TAKELAC (registered trademark) W-6061, WS-5100, and OLESTER (registered trademark) UD-350 (all manufactured by Mitsui Chemicals, Inc.).

Regarding the resin that is used as a binder, only one type may be used, or two or more types may be used in combination.

The content of the binder that is contained in the white layer is preferably 25 mass % to 90 mass %, and more preferably 30 mass % to 80 mass % with respect to a total solid content of the white layer. In a case where two or more types of binder resins are contained, the total amount of the binder resins is preferably within the above-described range.

The content of the binder is preferably within the above-described range since dispersibility of the white pigment in the white layer is improved, and thus the hardness of the white layer is maintained within a practically sufficient range.

[Other Components that May be Contained in White Layer]

In the white layer, in addition to the white pigment and the binder, other components such as known additives may be contained if desired within a range not impairing the effects of the present embodiment.

Examples of other components include silica having an average primary particle diameter of 200 nm or less, a cross-linking agent, a surfactant, an anti-foaming agent, a preservative, a fluorescent whitening agent, and a water resistant additive. In addition, although will be described later in detail, a colorant other than the white pigment is preferably contained in the white layer.

Hereinafter, other components that may be contained in the white layer will be described.

(Silica Having Average Primary Particle Diameter of 200 nm or Less)

The white layer may contain silica having an average primary particle diameter of 200 nm or less.

In a case where the white layer contains silica having an average primary particle diameter of 200 nm or less, scratch resistance of the white layer is further improved. As the average primary particle diameter of silica, a value calculated in the same manner as in the method of measuring the average primary particle diameter of the white pigment described above is used.

As the silica having an average primary particle diameter of 200 nm or less, a commercially available product that is widely used as "colloidal silica" or wet silica can be used.

In general, colloidal silica has a state of an aqueous dispersion in which silica particles are allowed to coexist with a dispersant (also called stabilizing agent) or the like if necessary.

Examples of the dispersant that may be contained if necessary in the aqueous dispersion of colloidal silica include quaternary ammonium salt and a silane coupling agent.

Silica particles that can be used in the white layer may be particles in which some of Si atoms existing on surfaces of silica particles are substituted with oxides or atoms of metals such as alumina and zinc.

A commercially available product may be used as the silica having an average primary particle diameter of 200 nm or less. Examples of commercially available products include SNOWTEX (registered trademark) series (manufactured by NISSAN CHEMICAL INDUSTRIES, LTD.) and AEROSIL (registered trademark) series (manufactured by NIPPON AEROSIL CO., LTD.).

The silica having an average primary particle diameter of 200 nm or less also functions as a white pigment. In a case where the above-described white pigment such as titanium oxide and silica having an average primary particle diameter of 200 nm or less are used in combination, scratch resistance of the white layer is further improved.

The above-described preferable content of the white pigment does not include the content of silica that is an arbitrary component.

In a case where silica having an average primary particle diameter of 200 nm or less is contained in the white layer, the content thereof with respect to a total mass of the entire components of the white layer is preferably in a range of 3 mass % to 20 mass %, and more preferably in a range of 5 mass % to 15 mass %.

(Cross-Linking Agent)

In the white layer, the binder contained in the white layer preferably has a cross-linked structure from the viewpoint of further improving the hardness of the white layer and the adhesiveness between the white layer and a layer adjacent thereto. A white layer-forming composition may contain a cross-linking agent for forming a cross-linked structure of the binder. As the cross-linking agent that may be contained in the white layer-forming composition, a compound that causes a cross-linking reaction with the binder contained in the white layer may be selected and used.

The cross-linking agent that may be contained in the white layer-forming composition is preferably selected from an oxazoline compound, a carbodiimide compound, an epoxy compound, an isocyanate compound, and a melamine compound.

—Oxazoline Compound—

The oxazoline compound is a compound having two or more oxazoline groups in a molecule.

Examples of the oxazoline compound include a polymer having an oxazoline group, such as a polymer that is obtained by copolymerizing a polymerizable unsaturated monomer having an oxazoline group with a polymerizable unsaturated monomer other than the polymerizable unsaturated monomer having an oxazoline group through a known method such as solution polymerization or emulsion polymerization if necessary.

Examples of the polymerizable unsaturated monomer having an oxazoline group include compounds containing 2-vinyl-2-oxazoline, 2-vinyl-4-methyl-2-oxazoline, 2-vinyl-5-methyl-2-oxazoline, 2-isopropenyl-2-oxazoline, 2-isopropenyl-4-methyl-2-oxazoline, or 2-isopropenyl-5-methyl-2-oxazoline as a monomer unit.

A commercially available product may be used as the oxazoline compound. Examples of commercially available products include EPOCROS (registered trademark) K-2020E, EPOCROS K-2010E, EPOCROS K-2020E, EPOCROS K-2030E, EPOCROS WS-300, EPOCROS WS-500, and EPOCROS WS-700 (all manufactured by NIPPON SHOKUBAI CO., LTD.).

—Carbodiimide Compound—

The carbodiimide compound is a compound having a functional group represented by —N═C═N—.

In general, polycarbodiimide is synthesized by a condensation reaction of organic diisocyanate. An organic group of the organic diisocyanate to be used for the synthesis is not particularly limited, and any one of an aromatic group and an aliphatic group, or a mixture of an aromatic group and an aliphatic group can be used. From the viewpoint of reactivity, an aliphatic group is particularly preferable. As raw materials for synthesis, organic isocyanate, organic diisocyanate, organic triisocyanate, or the like is used.

Specifically, 4,4'-diphenylmethane diisocyanate, 4,4-diphenyldimethylmethane diisocyanate, 1,4-phenylene diisocyanate, 2,4-tolylene diisocyanate, 2,6-tolylene diisocyanate, hexamethylene diisocyanate, cyclohexane diisocyanate, xylylene diisocyanate, 2,2,4-trimethylhexamethylene diisocyanate, 4,4'-dicyclohexylmethane diisocyanate, and 1,3-phenylene diisocyanate are used, and as an organic monoisocyanate, isophorone isocyanate, phenyl isocyanate, cyclohexyl isocyanate, butyl isocyanate, naphthyl isocyanate, and the like are used. As the carbodiimide compound, a commercially available product such as CARBODILITE (registered trademark) V-02-L2 (manufactured by Nisshinbo Holdings Inc.) is also available.

—Epoxy Compound—

The epoxy compound is a compound that has an epoxy group in a molecule and is obtained as a result of the reaction of the epoxy group. As the compound having an epoxy group in a molecule, a condensate of epichlorohydrin with a hydroxyl group or an amino group of ethylene glycol, polyethylene glycol, glycerin, polyglycerin, or bisphenol A is exemplified, and examples thereof include a polyepoxy compound, a diepoxy compound, a monoepoxy compound, and a glycidyl amine compound.

Examples of the polyepoxy compound include sorbitol, polyglycidyl ether, polyglycerol polyglycidyl ether, pentaerythritol polyglycidyl ether, diglycerol polyglycidyl ether, triglycidyl tris(2-hydroxyethyl)isocyanate, glycerol polyglycidyl ether, and trimethylolpropane polyglycidyl ether. Examples of the diepoxy compound include neopentyl glycol diglycidyl ether, 1,6-hexanediol diglycidyl ether, resorcin diglycidyl ether, ethylene glycol diglycidyl ether, polyethylene glycol diglycidyl ether, propylene glycol diglycidyl ether, polypropylene glycol diglycidyl ether, and polytetramethylene glycol diglycidyl ether. Examples of the monoepoxy compound include allyl glycidyl ether, 2-ethylhexyl glycidyl ether, and phenyl glycidyl ether. Examples of the glycidyl amine compound include N,N,N',N'-tetraglycidyl-m-xylylenediamine, and 1,3-bis(N,N-diglycidylamino)cyclohexane.

Specific examples of the water-soluble monomers having an epoxy group include "DENACOL (registered trademark)-614B" (sorbitol polyglycidyl ether, epoxy equivalent of 173, trade name, manufactured by Nagase ChemteX Corporation), "DENACOL-EX-313" (glycerol polyglycidyl ether, epoxy equivalent of 141, trade name, manufactured by Nagase ChemteX Corporation), "DENACOL-EX-521" (polyglycerol polyglycidyl ether, epoxy equivalent of 168, trade name, manufactured by Nagase ChemteX Corporation), and "DENACOL-EX-830" (polyethylene glycol diglycidyl ether, epoxy equivalent of 268, trade name, manufactured by Nagase ChemteX Corporation). These are commercially available.

—Isocyanate Compound—

The isocyanate compound is a compound having a partial structure of —N═C═O. Examples of organic isocyanate compounds include an aromatic isocyanate and an aliphatic isocyanate, and two or more types of compounds may be used in combination.

Specific examples thereof include 4,4'-diphenylmethane diisocyanate, 4,4-diphenyl dimethyl methane diisocyanate, 1,4-phenylene diisocyanate, 2,4-tolylene diisocyanate, 2,6-tolylene diisocyanate, hexamethylene diisocyanate, cyclohexane diisocyanate, xylylene diisocyanate, 2,2,4-trimethyl hexamethylene diisocyanate, 4,4'-dicyclohexylmethane diisocyanate, and 1,3-phenylene diisocyanate. Examples of organic monoisocyanates include isophorone isocyanate, phenyl isocyanate, cyclohexyl isocyanate, butyl isocyanate, and naphthyl isocyanate. Examples of the isocyanate compound further include ELASTRON (registered trademark) H-3 (manufactured by DKS Co., Ltd.), DP9C214 (manufactured by Baxenden Chemicals Ltd.), and TAKENATE (registered trademark) WD-HS30 (manufactured by Mitsui Chemicals, Inc.). These are commercially available.

—Melamine Compound—

The melamine compound is a compound having two or more methylol groups in a molecule. Examples of the melamine compound include hexamethylol melamine. Examples of commercially available melamine compounds include BECKAMINE (registered trademark) PM-N, BECKAMINE J-101, and BECKAMINE M-3 (all manufactured by DIC Corporation).

In a case where a cross-linking agent is contained in the white layer, only one type of cross-linking agent may be used, or two or more types of cross-linking agents may be used in combination.

In a case where a cross-linking agent is contained in a white layer-forming composition, the content of the cross-linking agent is preferably in a range of 3 mass % to 40 mass %, and more preferably in a range of 3 mass % to 35 mass % based on a total mass of the binder contained in the white layer.

In a case where the content of the cross-linking agent is within the above-described range, adhesiveness to a layer adjacent to the white layer, such as the resin base and the ink accepting layer, is further improved, and scratch resistance of the white layer is improved. In addition, the cross-linking density in the white layer is maintained within a suitable range, and thus even in a case where the white layer is exposed to, for example, a high temperature and high humidity environment in which the temperature is 60° C. or higher and the humidity is 90% or higher for a long period of time, it is possible to maintain good adhesiveness to an ink.

(Surfactant)

The white layer preferably contains a surfactant from the viewpoint of further improving manufacturing suitability to improve coating surface properties of a white layer-forming composition.

Examples of the surfactant include known anionic surfactants, nonionic surfactant, and cationic surfactants. The surfactants are described in, for example, "Handbook of Surfactants" (edited by Ichiro Nishi, Ichiro Imai, and Masatake Kasai, Sangyo-Tosho Publishing Co., Ltd., published in 1960).

As the surfactant contained in the white layer, a surfactant selected from an anionic surfactant and a nonionic surfactant is particularly preferable since it is an effective surfactant to improve wettability to a coating surface in a case where a white layer-forming coating liquid is applied.

Examples of the anionic surfactant include higher fatty acid salts such as potassium stearate and potassium behenate, alkyl ether carboxylates such as sodium polyoxyethylene (hereinafter, abbreviated as POE) lauryl ether carboxylate, N-acyl-L-glutamates such as N-stearoyl-L-glutamic acid monosodium salt, higher alkyl sulfate ester salts such as sodium lauryl sulfate and potassium lauryl sulfate, alkyl ether sulfate ester salts such as POE lauryl sulfate triethanolamine and sodium POE lauryl sulfate, N-acyl sarcosinates such as sodium lauroylsarcosine, higher fatty acid amide sulfonates such as sodium N-myristoyl-N-methyl taurine, alkyl phosphates such as sodium stearyl phosphate, alkyl ether phosphates such as sodium POE oleyl ether phosphate and sodium POE stearyl ether phosphate, sulfosuccinates such as sodium di-2-ethylhexyl sulfosuccinate, sodium monolauroyl monoethanolamide polyoxyethylene sulfosuccinate, and sodium lauryl polypropylene glycol sulfosuccinate, alkyl benzene sulfonates such as sodium linear dodecyl benzene sulfonate, linear dodecyl benzene, sulfonic acid triethanolamine, linear dodecyl benzene sulfonate, and dodecyl diphenyl ether disulfonate, and higher fatty acid ester sulfate ester salts such as hardened coconut oil fatty acid sodium glycerin sulfate.

Examples of commercially available anionic surfactants include RAPISOL (registered trademark) A-90, RAPISOL A-80, RAPISOL BW-30, RAPISOL B-90, RAPISOL C-70 (trade name: manufactured by NOF CORPORATION), NIKKOL (registered trademark) OTP-100 (manufactured by NIKKO CHEMICALS CO., LTD.), KOHAKURU (registered trademark) ON (manufactured by Toho Chemical Industry Co., Ltd.), KORAKURU L-40, (trade name, manufactured by Toho Chemical Industry Co., Ltd.), PHOSPHANOL (registered trademark) 702 (manufactured by Toho Chemical Industry Co., Ltd.), BEAULIGHT (registered trademark) A-5000, BEAULIGHT SSS, and SANDEDDO (registered trademark) BL (manufactured by Sanyo Chemical Industries, Ltd.).

Examples of the cationic surfactant include alkyl trimethyl ammonium salts such as stearyl trimethyl ammonium chloride and lauryl trimethyl ammonium chloride, dialkyl dimethyl ammonium salts such as distearyl dimethyl ammonium chloride, alkyl pyridinium salts such as poly(N,N-dimethyl-3,5-methylene piperidinium) chloride and cetyl pyridinium chloride, alkyl quaternary ammonium salts, alkyl dimethyl benzyl ammonium salts, alkyl isoquinolinium salts, dialkyl morpholinium salts, POE alkylamines, alkylamine salts, polyamine fatty acid derivatives, amyl alcohol fatty acid derivatives, benzalkonium chlorides, and benzethonium chloride. It is possible to suppress aggregation of particles during drying of a coating film and to form uniform unevenness on the surface using the above-described surfactant.

Examples of commercially available cationic surfactants include phthalocyanine derivative (trade name: EFKA-745 manufactured by MORISHITA & CO., LTD.), organosiloxane polymer KP341 (manufactured by Shin-Etsu Chemical Co., Ltd.), (meth)acrylic acid-based (co)polymer POLYFLOW No. 75, No. 90, No. 95 (manufactured by KYOEISHA CHEMICAL Co., LTD.), and W001 (manufactured by Yusho Co., Ltd.).

Examples of commercially available nonionic surfactants include NAROACTY (registered trademark) CL-95, HN-100 (manufactured by Sanyo Chemical Industries, Ltd.), LITHO REX (registered trademark) BW400 (manufactured by KOKYU ALCOHOL KOGYO CO., LTD.), EMALEX (registered trademark) ET-2020 (manufactured by Nihon Emulsion Co., Ltd.), UNILUBE (registered trademark) 50 MB-26, and NONION IS-4 (manufactured by NOF CORPORATION).

In a case where the white layer contains the surfactant, the content of the surfactant is preferably 0.01 mass % to 5.0 mass %, and more preferably 0.02 mass % to 2.0 mass % based on a total mass of the solid content of the white layer.

The white layer can be formed by, for example, applying a white layer-forming composition containing a white pigment, a binder, and other components that are used in combination if desired to the resin base, and drying the composition.

The thickness of the white layer is preferably 1 μm to 10 μm from the viewpoint that the white layer excellently serves as a white background in the formation of a decorative illumination image.

The thickness of the white layer is more preferably 1 μm to 8 μm, and even more preferably 2 μm to 6 μm.

The decorative illumination recording sheet may have only one white layer, or two or more white layers. In a case where the decorative illumination recording sheet has a plurality of white layers, the white layers may have different compositions. The decorative illumination recording sheet according to the present embodiment may have a white layer on, for example, both surfaces of the resin base.

In a case where the decorative illumination recording sheet has a plurality of white layers, the thickness of one white layer is preferably 0.5 μm to 4 μm, and more preferably 1 μm to 3 μm. The total thickness of the plurality of white layers is preferably within the range of 1 μm to 10 μm described above.

[Resin Base]

The resin base 12 of the decorative illumination recording sheet 10 according to the present embodiment is preferably a resin sheet. The above-described white layer 14 may be provided on one surface, or both surfaces of the resin base 12. Hereinafter, a side of the resin base 12, on which the white layer 14 on which the decorative illumination image is formed is provided will be referred to as the front surface, and a side that is disposed on the light source side will be referred to as the back surface or the rear surface.

As the resin that is used as the resin base, a polyester resin is preferable from the viewpoint of excellent weather fastness.

The polyester resin that is used as the resin base 12 is not particularly limited, and examples thereof include polyethylene terephthalate, polyethylene naphthalate, polybutylene terephthalate, and polybutylene naphthalate. Among these, polyethylene terephthalate is preferable from the viewpoint of higher mechanical strength.

The resin base may contain, in addition to the resin constituting the base, additives such as a pigment and a plasticizer according to the purpose within a range not impairing the effects of the present embodiment.

The resin sheet is preferably prepared through a process including stretching, and more preferably biaxially stretched from the viewpoint of further improving a mechanical strength of the resin sheet as the resin base 12.

The stretching ratio is not particularly limited, and is preferably in a range of 1.5 times to 7 times. In a case where the stretching ratio is within the above-described range, a sufficient mechanical strength as a resin base is obtained and thickness uniformity is improved.

The stretching ratio is more preferably in a range of 2 times to 5 times. Regarding the direction and the ratio of the stretching, the stretching is even more preferably performed in two directions perpendicular to each other in a range of 2 times to 5 times in each of the directions.

The thickness of the resin base 12 may be, for example, in a range of 30 μm to 500 μm, and is preferably in a range of 50 μm to 300 μm. In a case where the thickness of the resin base 12 is within the above-described range, the resin base becomes easy to handle and is advantageous in manufacturing. In addition, downsizing and weight reduction of a decorative illumination recording sheet and a decorative illumination signboard provided with the decorative illumination recording sheet to be obtained are easily achieved, and thus a cost of the resin base involved in the manufacturing cost is reduced.

The front surface and the rear surface of the resin base 12 are preferably subjected to a surface treatment such as a corona discharge treatment, a vacuum glow discharge treatment, or a flame treatment from the viewpoint of further improving adhesion to other layers provided adjacent to the resin base 12.

[Colorant Different from White Pigment]

The decorative illumination recording sheet 10 according to the present embodiment contains a colorant different from the white pigment (hereinafter, may be simply referred to as "colorant").

From the viewpoint of the effects, the colorant is preferably a colorant having absorption at a wavelength of at least 700 nm to 900 nm. The colorant may be a dye or a pigment, and is preferably a pigment from the viewpoint of higher light resistance and durability.

Examples of the pigment having absorption at a wavelength of at least 700 nm to 900 nm include a blue pigment, a green pigment, a violet pigment, and a brown pigment.

Examples of the blue pigment include PRUSSIAN BLUE (Pigment Blue 27, composition: $Fe_4[Fe(CN)_6]_3$), COBALT BLUE (Pigment Blue 28, composition: Co—Al oxide), COBALT BLUE (Pigment Blue 36, composition: Co—Cr—Al oxide), COBALT BLUE (Pigment Blue 74, composition: Co—Zn—Si oxide), ULTRAMARINE (Pigment Blue 29), PHTHALOCYANINE BLUE (Pigment Blue 15, composition: copper phthalocyanine), METAL-FREE PHTHALOCYANINE (Pigment Blue 16), INDANTHRENE BLUE (Pigment Blue 60), Pigment Blue 15:3, Pigment Blue 15:4, and Pigment Blue 15:6.

Examples of the green pigment include PHTHALOCYANINE GREEN (Pigment Green 7, composition: highly chlorinated copper phthalocyanine), COBALT GREEN (Pigment Green 50, composition: Co—Zn—Ni—Ti oxide), COBALT GREEN (Pigment Green 26, composition: Co—Zn—Cr—Ti oxide), Pigment Green 36, and Pigment Green 58.

Examples of the violet pigment include DIOXAZINE VIOLET (Pigment Violet 23, composition: dioxazine).

Examples of the brown pigment include SIENNA (Pigment Brown 7, composition: iron oxide).

Among these, as the colorant, at least one type selected from the group consisting of phthalocyanine pigments, dioxazine pigments, and cobalt oxide pigments is preferable in view of the fact that it has good light absorbability and light scattering properties on the long wavelength side in an LED light source. Among the above-described pigments, phthalocyanine pigments selected from the group consisting of Pigment Blue 15, Pigment Blue 16, and Pigment Green 7, cobalt oxide pigments selected from the group consisting of Pigment Blue 28, Pigment Blue 36, Pigment Blue 74, Pigment Green 50, and Pigment Green 26, and dioxazine pigments such as Pigment Violet 23 are exemplified as preferable pigments.

(Purification of Colorant)

The colorant may contain impurities such as insoluble dust causing a planar failure called cissing, a small amount of metal atom-containing components derived from a raw material that is used, and a silicone-containing component. Therefore, in a case where the colorant contains impurities, the colorant is preferably purified through a usual method to remove the impurities, or a colorant in which the content of impurities is reduced is preferably used.

The method of purifying the colorant is not particularly limited. Examples of the simple purification method include filter filtration, washing, and reprecipitation, and means for purification through filter filtration is preferable. Two or more purification methods may be performed in combination.

The filter filtration method that is a preferable purification method is not particularly limited. Examples of the filter filtration method include a method of removing impurities by passing a previously prepared colorant dispersion liquid through a filter such as a depth filter or a screen filter formed to include a material selected from polypropylene, glass fiber, TEFLON (registered trademark), and the like a predetermined number of times, for example, at least once. The filter filtration is performed at least once, preferably performed once to 5 times, and more preferably performed once to 3 times. The filter filtration method is effective to remove a silicone-containing component and the like.

The colorant may be contained in any layer of the decorative illumination recording sheet 10 according to the present embodiment. The colorant may be contained in, for example, at least one selected from the white layer and an ink accepting layer, a hard coat layer, an antistatic layer, an adhesive layer, and the like that are provided if desired.

Furthermore, a colorant layer containing a colorant and a resin may be provided as a layer different from the above-described layers. The colorant may be contained in the resin base.

The colorant may be contained in only one layer, or in a plurality of layers.

Among these, the white layer preferably contains the colorant. In a case where the colorant is contained in the same layer as the white pigment, the colorant more effectively suppresses the transmission of light on the long wavelength side by an LED light source without reducing the transmittance of visible light due to a synergistic effect with light reflection and light scattering by the white pigment present adjacent thereto. Accordingly, in a case where the colorant is contained in the same amount in the white layer, the effect is enhanced, and thus the content of the colorant can be reduced as compared with a case in which the colorant is contained in a different layer.

In the decorative illumination recording sheet, only one type of colorant may be contained, or two or more types of colorants may be used in combination. From the viewpoint of adjusting the degree of whiteness in the decorative illumination recording sheet and further improving the degree of freedom of tone adjustment, it is also preferable that two or more types of colorants having different absorption wavelengths are used in combination.

The total content of the colorant in the decorative illumination recording sheet is preferably 0.5 $mg/m^2$ or greater and less than 50.0 $mg/m^2$, more preferably 1 $mg/m^2$ to 20 $mg/m^2$, and even more preferably 3 $mg/m^2$ to 10 $mg/m^2$.

In a case where the content of the colorant is within the above-described range, light on the long wavelength side from an LED light source can be effectively reduced while the transmittance of visible light, that is, the brightness of a formed decorative illumination image is maintained. Thus, conditions specified in the following embodiment can be more effectively satisfied.

In addition, in a case where a pigment selected from a blue pigment, a green pigment, a violet pigment, and the like is used in combination as the colorant, this is advantageous in that a background having a visually higher degree of whiteness is observed when a decorative illumination signboard is observed with the naked eye.

[Arbitrary Layer in Decorative Illumination Recording Sheet]

In the decorative illumination recording sheet 10 according to the present embodiment, in addition to the white layer 14, other arbitrary layers can be provided according to the purpose within a range not impairing the effects of the present embodiment.

In a case where a decorative illumination image is formed in the decorative illumination recording sheet 10 according to the present embodiment, the image is preferably formed through an ink jet recording method. In a case where a decorative illumination image is formed through an ink jet recording method, an ink accepting layer 16 may be further provided as illustrated in FIG. 1 on a surface of the white layer 14 disposed on the resin base in order to improve accepting properties of an ink jet recording ink composition and to improve adhesiveness of an ink image.

(Ink Accepting Layer)

The ink accepting layer 16 is disposed as an outermost layer on a side of the white layer 14 disposed on the resin base 12, opposite to the resin base 12.

The ink accepting layer 16 is provided to increase the adhesion to an ink composition such as an ink jet recording ink composition that can be used in the formation of a decorative illumination image (hereinafter, may be referred to as "ink"). Particularly, the ink accepting layer is useful to suppress bleeding of the ink discharged from an ink jet recording device and to obtain a clear image in ink jet recording.

The ink accepting layer preferably contains a resin, and at least a part of the resin preferably includes a cross-linked structure formed by a cross-linking agent.

The resin contained in the ink accepting layer 16 is not particularly limited. Examples of the resin that is used in the ink accepting layer include a polyester resin, a polyurethane resin, an acrylic resin, a styrene-butadiene copolymer resin, and a polyolefin resin, and at least one selected from the above-described resins is preferably contained. The resin contained in the ink accepting layer 16 is particularly preferably a water-soluble or water-dispersible resin in view of less environmental load.

As the polyester resin, the polyurethane resin, the acrylic resin, and the polyolefin resin, the resins described as the resin contained in the white layer described above are suitably used as a resin contained in the ink accepting layer 16, and preferable aspects are also similar.

The ink accepting layer 16 preferably contains a polyester resin and a polyurethane resin. The content ratio between the polyester resin and the polyurethane resin is preferably 0.1/0.9 to 0.9/0.1, more preferably 0.3/0.7 to 0.7/0.3, and even more preferably 0.4/0.6 to 0.6/0.4 in terms of a mass ratio of polyester resin/polyurethane resin.

An ink accepting layer-forming composition may contain a cross-linking agent, and preferably has a structure in which the resin contained in the ink accepting layer is cross-linked by a cross-linking agent.

The cross-linking agent preferably contains at least one selected from an oxazoline compound and a carbodiimide compound.

As the oxazoline compound and the carbodiimide compound that are preferable cross-linking agents in the ink accepting layer, the oxazoline compound and the carbodiimide compound that are the cross-linking agents described in the description of the white layer can be similarly used, and preferable aspects are also similar.

The cross-linking agent used in the formation of the ink accepting layer is preferably contained in a range of 3 mass % to 30 mass %, and more preferably contained in a range of 3 mass % to 20 mass % with respect to the resin contained in the ink accepting layer.

In a case where the cross-linking agent is contained in an amount of 3 mass % or greater with respect to the resin, the ink easily penetrates the ink accepting layer, and thus there is an advantage in that an image having excellent fixing properties between the ink accepting layer and the ink after image formation is easily obtained. By adding the cross-linking agent in a range of 30 mass % or less with respect to the resin, an appropriate amount of a cross-linked structure is formed in a case where the resin of the ink accepting layer forms a cross-linked structure with the cross-linking agent. In a case where the resin in the ink accepting layer has a cross-linked structure, an image in which high adhesiveness is maintained between the ink and the ink accepting layer is obtained even in a case of being exposed to, for example, a high temperature and high humidity environment in which the temperature is 60° C. or higher and the relative humidity is 90% or higher for a long period of time.

The ink accepting layer may contain a surfactant, a lubricant, an anti-foaming agent, a dye, a fluorescent whitening agent, a preservative, a water resistant additive, particles, and the like if necessary.

Examples of the surfactant that can be used in the ink accepting layer include the same surfactants as those that can be used in the white layer described above.

—Lubricant—

In a case where the ink accepting layer contains a lubricant, scratch resistance of the surface of the decorative illumination recording sheet 10 is improved.

As the lubricant that can be used in the ink accepting layer, an aliphatic wax or the like is suitably used.

Specific examples of the aliphatic wax include vegetable waxes such as a carnauba wax, a candelilla wax, a rice wax, a Japan wax, jojoba oil, a palm wax, a rosin-modified wax, an ouricury wax, a sugar cane wax, an esparto wax, and a bark wax, animal waxes such as a bees wax, lanolin, a whale wax, an insect wax, and a shellac wax, mineral waxes such as a montan wax, ozocerite, and a ceresin wax, petroleum waxes such as a paraffin wax, a microcrystalline wax, and petrolactam, and synthetic hydrocarbon waxes such as a Fischer-Tropsch wax, a polyethylene wax, a polyethylene oxide wax, a polypropylene wax, and a polypropylene oxide wax. Among these, a carnauba wax, a paraffin wax, and a polyethylene wax are preferable.

The lubricant can be used as an aqueous dispersion in view of less environmental load and good handleability.

A commercially available product may be used as the lubricant that can be used in the present embodiment. Examples of commercially available products include CELLOSOL (registered trademark) 524 (manufactured by CHUKYO YUSHI CO., LTD.).

In the ink accepting layer, only one type of lubricant may be used, or two or more types of lubricants may be used in combination.

—Preservative—

Examples of the preservative that can be used in the ink accepting layer include sodium dehydroacetate, sodium benzoate, sodium pyridinethione-1-oxide, p-hydroxybenzoic acid ethyl ester, 1,2-benzothiazoline-3-one, sodium sorbate, and sodium pentachlorophenol.

—Thickness of Ink Accepting Layer—

The thickness of the ink accepting layer can be controlled by adjusting the coating amount of a coating liquid for forming the ink accepting layer.

In order to increase transparency and exhibit excellent adhesion to an ink in a case where a decorative illumination signboard is formed using a decorative illumination recording sheet, the thickness of the ink accepting layer is preferably in a range of 0.01 μm to 5 μm, more preferably in a range of 0.02 μm to 3 μm, and even more preferably 0.1 μm to 1 μm.

In a case where the thickness of the ink accepting layer is 0.01 μm or greater, the adhesion to an ink can be more securely improved as compared with a case where the thickness is less than 0.01 μm. In a case where the thickness is 5 μm or less, the ink accepting layer can be formed so as to have a more uniform thickness as compared with a case where the thickness is greater than 5 μm. Moreover, an increase in the amount of the coating liquid used is suppressed, and thus an increase in the drying time can be suppressed, and productivity of the decorative illumination recording sheet can be further improved.

(Antistatic Layer)

The decorative illumination recording sheet 10 according to the present embodiment preferably has an antistatic layer 18. The decorative illumination recording sheet 10 having the antistatic layer 18 can effectively suppress adhesion of dust occurring due to static electricity generated during the production of a decorative illumination signboard by installing a decorative illumination image sheet on a decorative illumination frame. In addition, in a case where a decorative illumination image is formed through an ink jet recording method, it is possible to suppress the occurrence of malfunction during the ink jet recording due to static electricity.

The antistatic layer can be provided between the resin base and the white layer, or between the white layer and the ink accepting layer.

In the aspect illustrated in FIG. 1, the antistatic layer 18 is disposed on the rear surface side of the resin base 12, not on a side of the resin base 12 on which the ink accepting layer 16 is provided adjacent to the white layer 14. The antistatic layer 18 is preferably provided on the rear surface of the resin base 12 since the dust adhesion preventing effect during installation in which the decorative illumination recording sheet 10 is attached to a decorative illumination signboard is further improved. In addition, for example, in a case where a decorative illumination image is formed through an ink jet recording method, the dust adhesion preventing effect during printing is further improved.

—Metal Oxide—

The antistatic layer 18 preferably contains a metal oxide.

Examples of the metal oxide include oxides of metals such as tin, zinc, titanium, aluminum, indium, magnesium, barium, and molybdenum. Specific examples thereof include metal oxides such as $SnO_2$, ZnO, $TiO_2$, $Al_2O_3$, $In_2O_3$, MgO, BaO, and $MoO_3$, and metal composite oxides including two or more types of metals. The metal oxide may be a dissimilar metal composite metal oxide in which a metal oxide or a metal composite oxide contains a dissimilar atom.

As the metal oxide, $SnO_2$, ZnO, $TiO_2$, $Al_2O_3$, $In_2O_3$, or MgO is preferable, and $SnO_2$ is particularly preferable. As $SnO_2$, $SnO_2$ doped with antimony is preferable, and $SnO_2$ doped with antimony in a range of 0.2 mol % to 2.0 mol % is particularly preferable.

The metal oxide is contained as particles in the antistatic layer 18. The shape of the particles is not particularly limited, and the particles may have any shape such as a spherical shape, a cube shape, an octahedron shape, a needle shape, and a spindle shape.

The average primary particle diameter of the metal oxide is preferably 0.4 μm to 3.0 μm. In a case where the average primary particle diameter of the metal oxide is within the above-described range, malfunction rarely occurs during ink jet recording, and it is possible to easily obtain a decorative illumination recording sheet on which an image to which dust rarely adheres can be formed.

In the present embodiment, as the average primary particle diameter of the metal oxide, a value calculated in the same manner as in the method of measuring the average primary particle diameter of the white pigment is used. In a case where the metal oxide particles do not have a spherical shape, the longest diameter of the particles is set as a particle diameter.

The amount of the metal oxide contained in the antistatic layer is preferably 10 mass % to 80 mass %, and more preferably 30 mass % to 60 mass % based on a total mass of the solid content of the antistatic layer.

In a case where the content of the metal oxide in the antistatic layer is within the above-described range, it is possible to easily obtain a decorative illumination recording sheet on which an image to which dust rarely adheres can be formed.

—Resin Contained in Antistatic Layer—

The resin contained in the antistatic layer 18 is a resin functioning as a binder that uniformly disperses the metal oxide and fixes the antistatic layer 18 to the other surface of the resin base.

The resin that may be contained in the antistatic layer 18 may be any one of a water-insoluble resin, a water-soluble resin, and a water-dispersible resin. In view of less environmental load, the resin is preferably a water-soluble or water-dispersible resin.

The resin contained in the antistatic layer 18 preferably includes at least one selected from a polyester resin, a polyurethane resin, and an acrylic resin.

As the polyester resin, the polyurethane resin, and the acrylic resin, the resins described as the resin contained in the white layer described above can also be used in the antistatic layer, and preferable resins are also similar to those in the case of the white layer.

The antistatic layer 18 may contain a resin other than a polyester resin, a polyurethane resin, and an acrylic resin that are preferable resins.

Examples of other resins include a polystyrene resin, a polyolefin resin, and a polyamide resin.

The amount of the resin contained in the antistatic layer 18 is preferably 30 mass % to 80 mass %, and more preferably 40 mass % to 60 mass % based on a total mass of the solid content of the antistatic layer 18.

In a case where the content of the resin in the antistatic layer 18 is within the above-described range, it is possible to obtain an image in which adhesion of dust is suppressed. In addition, the occurrence of malfunction due to static electricity during the formation of a decorative illumination image through an ink jet recording method is suppressed.

The antistatic layer 18 may contain a surfactant.

Examples of the surfactant that can be used in the antistatic layer include known anionic surfactants, nonionic surfactants, cationic surfactants, fluorine-containing surfactants, and silicon-containing surfactants. The surfactants are described in, for example, "Handbook of Surfactants" (edited by Ichiro Nishi, Ichiro Imai, and Masatake Kasai, Sangyo-Tosho Publishing Co., Ltd., published in 1960), and surfactants described in the above literature can be appropriately selected and used in the antistatic layer.

The surfactant used in the antistatic layer 18 is preferably a surfactant selected from the group consisting of an anionic surfactant and a nonionic surfactant.

As the anionic surfactant and the nonionic surfactant, the surfactants described in the description related to the white layer are exemplified and also suitably used in the antistatic layer 18. Preferable aspects are also similar.

In a case where the antistatic layer 18 contains a surfactant, the content of the surfactant is preferably 0.5 mass % to 5.0 mass %, and more preferably 0.5 mass % to 3.0 mass % based on a total mass of the solid content of the antistatic layer 18.

The thickness of the antistatic layer 18 is preferably in a range of 0.05 μm to 5.0 μm from the viewpoint of obtaining a more excellent antistatic effect. The thickness of the antistatic layer 18 is more preferably 0.07 μm to 3.0 μm.

A surface of the decorative illumination recording sheet according to the present embodiment on a side having the antistatic layer preferably has a surface resistivity of $1.0\times10^{12}$ Ω/sq or less, and more preferably has a surface resistivity of $1.0\times10^{11}$ Ω/sq or less at a temperature of 23° C. with a relative humidity of 30%.

In a case where the surface resistivity of the antistatic layer is $1.0\times10^{12}$ Ω/sq or less, a decorative illumination recording sheet, on which a decorative illumination image to which dust rarely adheres can be obtained, is provided. In addition, in a case where the surface resistivity is $1.0\times10^{12}$ Ω/sq or less, the occurrence of malfunction due to static electricity during the formation of a decorative illumination image through an ink jet recording method is suppressed.

"A surface of the decorative illumination recording sheet on a side having the antistatic layer" means a surface of an outermost layer among the layers existing on a side having the antistatic layer on the rear surface of the resin base. For example, in a case where the antistatic layer and a hard coat layer to be described later are sequentially provided on the rear surface of the resin base, "the surface of the decorative illumination recording sheet on a side having the antistatic layer" means a surface of the hard coat layer.

In the present specification, as the surface resistivity, a value measured based on JIS-K-6911-1995 is used.

(Hard Coat Layer)

As illustrated in FIG. 1, in a case where the decorative illumination recording sheet 10 according to the present embodiment has the above-described antistatic layer 18 on the rear surface of the resin base 12, a hard coat layer 20 is preferably further provided on an upper surface of the antistatic layer 18 in order to protect the antistatic layer 18. The hard coat layer 20 is preferably provided as an outermost layer of the rear surface of the resin base 12 as illustrated in FIG. 1.

In a case where the hard coat layer 20 covers the surface of the antistatic layer 18, physical damages of the antistatic layer 18 are effectively suppressed.

The hard coat layer 20 preferably contains particles and a resin from the viewpoint of improving protective properties of the antistatic layer 18 and further improving scratch resistance of a surface of the hard coat layer 20.

The hard coat layer 20 may further contain a surfactant. As the surfactant, the same surfactants as those in the white layer described above can be used.

—Particles—

The particles that may be contained in the hard coat layer are preferably at least one selected from the group consisting of inorganic particles and organic resin particles.

Examples of the inorganic particles include titanium oxide, silica, calcium carbonate, talc, zeolite, alumina, barium sulfate, and kaolinite.

The organic resin particles are preferably made of a cross-linked resin, and examples thereof include cross-linked acrylic resin particles, cross-linked methacrylic resin particles, and cross-linked polystyrene resin particles.

The cross-linked resin particles can be used in the form of an aqueous dispersion.

The content of the particles contained in the hard coat layer is preferably 20 mass % or less, and more preferably in a range of 1 mass % to 10 mass % based on a total mass of the solid content of the hard coat layer.

The average primary particle diameter of the particles contained in the hard coat layer is preferably larger than the thickness of the hard coat layer to be described later. The average primary particle diameter of the particles contained in the hard coat layer is preferably in a range of 0.4 μm to 3.0 μm.

Here, as the average primary particle diameter of the particles contained in the hard coat layer, a value measured and calculated in the same manner as in the method of measuring the average primary particle diameter of the white pigment described above is used.

—Resin—

The resin contained in the hard coat layer is preferably a resin that functions as a binder with respect to the particles contained in the hard coat layer and has good adhesiveness to the adjacent antistatic layer.

Examples of the resin that may be contained in the hard coat layer 20 include the same resins as those that may be contained in the white layer 14 described above. At least a part of the resin that may be contained in the hard coat layer may include a cross-linked structure formed using a cross-linking agent.

As the resin that may be contained in the hard coat layer, a silicon-containing resin is preferable in view of the fact that a hard coat layer having hardness of F or higher in terms of pencil hardness can be formed, and thus an excellent protection effect is obtained for the antistatic layer.

—Silicon-Containing Resin—

The silicon-containing resin that is suitable for forming the hard coat layer 20 is preferably a resin that has a structure including a three-dimensional structure in which a silicon atom and an oxygen atom are bonded to each other, and is obtained by hydrolyzing and condensing an alkoxysilane that is known as a silane coupling agent.

An alkoxysilane may be a mixture obtained by combining a tetrafunctional alkoxysilane having four alkoxy groups with a bifunctional alkoxysilane or a trifunctional alkoxysilane having two or three alkoxy groups, and a silicon-containing resin obtained by hydrolyzing and condensing the alkoxysilane mixture is particularly preferable for forming the hard coat layer. The alkoxysilane mixture for obtaining a silicon-containing resin may be a mixture obtained by combining a bifunctional alkoxysilane, a trifunctional alkoxysilane, and a tetrafunctional alkoxysilane.

The mixing ratio between the tetrafunctional alkoxysilane and at least one selected from a bifunctional alkoxysilane and a trifunctional alkoxysilane in the mixture is preferably in a range of 25:75 to 85:15, and more preferably in a range of 30:70 to 70:30 in terms of a molar ratio of the former (tetrafunctional alkoxysilane):the latter (at least one selected from bifunctional alkoxysilane and trifunctional alkoxysilane).

Specific examples of the tetrafunctional alkoxysilane include tetramethoxysilane, tetraethoxysilane, tetrapropoxysilane, tetrabutoxysilane, methoxytriethoxysilane, ethoxytrimethoxysilane, methoxytripropoxysilane, ethoxytripropoxysilane, propoxytrimethoxysilane, propoxytriethoxysilane, and dimethoxydiethoxysilane. Among these, tetramethoxysilane and tetraethoxysilane are preferable.

The trifunctional alkoxysilane preferably has an epoxy group, and specific examples thereof include glycidyl trimethoxysilane, 3-glycidoxypropyltrimethoxysilane, 3-glycidoxypropyltriethoxysilane, 2-(3,4-epoxycyclohexyl) ethyltrimethoxysilane, and 2-(3,4-epoxycyclohexyl)ethyltriethoxysilane.

Examples of the bifunctional alkoxysilane include dimethyldimethoxysilane, diethyldimethoxysilane, dimethyldiethoxysilane, and diethyldiethoxysilane.

—Catalyst—

In a case where the hard coat layer 20 is formed using a silicon-containing resin, a catalyst is preferably contained in a hard coat layer-forming composition in the hydrolysis and condensation of an alkoxysilane.

As the catalyst, an acidic compound (hereinafter, also referred to as "acidic catalyst") or a basic compound (hereinafter, also referred to as "basic catalyst") is contained. The catalyst may be dissolved in a solvent such as water or alcohol before use.

In a case where an acidic catalyst or a basic catalyst is dissolved in a solvent, the concentration thereof is not particularly limited, and may be appropriately selected according to characteristics, a desired content, and the like of the catalyst to be used.

Here, there is a tendency that the rate of the hydrolysis and polycondensation may increase in a case where the concentration of an acidic catalyst or a basic catalyst in the hard coat layer-forming composition is high. However, in a case where a basic catalyst is used in such an amount that its concentration becomes too high, a precipitate is generated and becomes a defect, and thus it becomes difficult to form a uniform hard coat layer 20 in some cases. Accordingly, in a case where a basic catalyst is used, the concentration thereof is desirably 1 N or less in terms of concentration in an aqueous solution of a composition for forming a hard coat layer.

The type of the acidic catalyst or the basic catalyst is not particularly limited. However, in a case where it is necessary to use a high-concentration catalyst, a catalyst having an element that hardly remains in a conductive layer is preferable.

Specific examples of the acidic catalyst include hydrogen halides such as hydrochloric acid, carboxylic acids such as nitric acid, sulfuric acid, sulfurous acid, hydrogen sulfide, perchloric acid, hydrogen peroxide, carbonic acid, formic acid, and acetic acid, substituted carboxylic acids where R in the structural formula represented by RCOOH is substituted with an element or a substituent other than a hydrogen atom, and sulfonic acids such as benzenesulfonic acid. Specific examples of the basic catalyst include ammoniacal bases such as ammonia water and amines such as ethylamine and aniline.

The catalyst is preferably used in a range of 0 mass % to 50 mass %, and more preferably in a range of 5 mass % to 25 mass % with respect to the non-volatile component of a reaction liquid that hydrolyzes and condenses an alkoxysilane. The catalyst may be used alone, or two or more types of catalysts may be used.

The reaction liquid that hydrolyzes and condenses an alkoxysilane may contain a curing agent such as a metal chelate compound such as an aluminum chelate compound, a surfactant, and the like. Examples of the surfactant that can be used in the reaction liquid include known anionic surfactants, nonionic surfactants, cationic surfactants, fluorine-based surfactants, and silicone-based surfactants, similarly to those in the description related to the antistatic layer.

—Solvent—

The reaction liquid that hydrolyzes and condenses an alkoxysilane that is used in the formation of the hard coat layer 20 may contain an organic solvent.

Examples of the organic solvent include ketones such as acetone, methyl ethyl ketone, and diethyl ketone; alcohols such as methanol, ethanol, 2-propanol, 1-propanol, 1-butanol, and tert-butanol; chlorine-containing solvents such as chloroform and methylene chloride; aromatic compounds such as benzene and toluene; esters such as ethyl acetate, butyl acetate, and isopropyl acetate; ether-based solvents such as diethyl ether, tetrahydrofuran, and dioxane; and glycol ethers such as ethylene glycol monomethyl ether and ethylene glycol dimethyl ether.

In a case where an organic solvent is contained in the reaction liquid, the content thereof is preferably in a range of 50 mass % or less, and more preferably in a range of 30 mass % or less based on a total mass of the sol-gel coating liquid from the viewpoint of the effects.

In a case where the reaction liquid that hydrolyzes and condenses an alkoxysilane and the above-described particles are mixed, the resulting mixed liquid is applied to the surface of the antistatic layer, and heating and drying are performed thereon, a hydrolysis and condensation reaction of the alkoxysilane occurs in the coating film on the antistatic layer, and a hard coat layer is formed.

The heating temperature is preferably in a range of 30° C. to 200° C., and more preferably in a range of 50° C. to 180° C. The heating and drying time is preferably 10 seconds to 300 minutes, and more preferably 1 minute to 120 minutes.

The thickness of the hard coat layer is preferably in a range of 0.4 μm to 3.0 μm, more preferably in a range of 0.7 μm to 2.0 μm, and even more preferably in a range of 0.8 μm to 1.8 μm.

In a case where the hard coat layer contains particles, the average primary particle diameter of the particles is preferably larger than the thickness of the hard coat layer as described above. However, for example, in a case of using particles having an average primary particle diameter that is 2.5 times larger than the layer thickness, there is a concern that the particles contained in the hard coat layer may be separated. Therefore, in a case where the thickness of the hard coat layer is set to 1, the average primary particle diameter of the particles is preferably 1 time larger and not 2.0 times larger than the thickness from the viewpoint of stability.

Since the decorative illumination recording sheet according to the present embodiment satisfies both of the prevention of show-through of an LED light source image in the decorative illumination recording sheet using an LED light source and the brightness of a display image in a case where a decorative illumination signboard is formed and a decorative illumination image is displayed, the decorative illumination recording sheet can be suitably used for a decorative illumination signboard for indoor or outdoor use.

In addition, since the decorative illumination recording sheet according to the present embodiment can maintain high image brightness, the decorative illumination recording sheet gives a useful effect from the viewpoint of electricity saving that in a case where image display is performed with the same brightness as before, less power is consumed than in a case of a decorative illumination image using a conventional decorative illumination recording sheet.

<Method of Preparing Decorative Illumination Recording Sheet>

A method of preparing a decorative illumination recording sheet according to the present embodiment is the method of preparing a decorative illumination recording sheet according to the present embodiment described above, including: forming a white layer by applying a white layer-forming coating liquid containing a white pigment and a binder to at least one side of a resin base; and adjusting, in a case where an average transmittance in a wavelength range of 400 nm to 700 nm is represented by Tv and an average transmittance in a wavelength range exceeding 700 nm, but not exceeding 800 nm is represented by Tr, Tv and Tr within a range satisfying the relationships expressed by Formulae (1) and (2) using a colorant different from the white pigment.

$$40.0\% \leq Tv < 50.0\% \quad (1)$$

$$40.0\% \leq Tr < 50.0\% \quad (2)$$

In addition, in a case where a decorative illumination image in the decorative illumination recording sheet according to the present embodiment is formed through an ink jet recording method, forming an ink accepting layer by applying an ink accepting layer-forming coating liquid to the white layer may be further included.

Forming a white layer may include adjusting Tv and Tr within a range satisfying the relationships expressed by Formulae (1) and (2). That is, in the formation of a white layer, by forming the white layer by applying a white layer-forming coating liquid containing a white pigment, a binder, and a colorant different from the white pigment, Tv and Tr of the decorative illumination recording sheet may be adjusted within a range satisfying the relationships expressed by Formulae (1) and (2).

Hereinafter, a preferable method of preparing a decorative illumination recording sheet according to the present embodiment will be described.

A decorative illumination recording sheet 10 illustrated in FIG. 1, that is an aspect of the invention, is prepared by forming a white layer 14 and an ink accepting layer 16 on one surface of a resin base 12, and forming an antistatic layer 18 and a hard coat layer 20 on the other surface.

The white layer 14 and the ink accepting layer 16 disposed on one surface of the resin base 12 can be formed by sequential application or simultaneous multilayer application of a white layer-forming coating liquid and an ink accepting layer-forming coating liquid, and drying the liquids.

In the preparation method according to the present embodiment, first, a white layer is formed by applying a white layer-forming coating liquid containing a white pigment and a binder to one surface of the resin base 12 (forming a white layer).

Furthermore, in a case where an average transmittance of the decorative illumination recording sheet in a wavelength range of 400 nm to 700 nm is represented by Tv and an average transmittance in a wavelength range exceeding 700 nm, but not exceeding 800 nm is represented by Tr, Tv and Tr are adjusted within a range satisfying the relationships expressed by Formulae (1) and (2) using a colorant different from the white pigment (adjusting a transmittance of the decorative illumination recording sheet).

In a preferable aspect of the present embodiment, the white layer-forming coating liquid may contain, in addition to a white pigment and a binder, a colorant different from the white pigment and a binder.

Means for adjusting Tv and Tr of the decorative illumination recording sheet according to the present embodiment within a range satisfying the relationships expressed by Formulae (1) and (2) is as described in detail in the section related to the decorative illumination recording sheet.

The antistatic layer 18 and the hard coat layer 20 disposed on the rear surface of the resin base 12 can be formed by sequential application or simultaneous multilayer application of an antistatic layer-forming coating liquid and a hard coat layer-forming coating liquid, and drying the liquids. The preparation method according to the present embodiment may further have another step if necessary.

Each composition can be applied by applying a known application method using, for example, a blade coater, an air-knife coater, a roll coater, a bar coater, a gravure coater, a reverse coater, or the like according to the purpose.

The coating amount of the ink accepting layer-forming coating liquid used to form the ink accepting layer 16 is preferably 5 $g/m^2$ to 20 $g/m^2$, and more preferably 7 $g/m^2$ to 10 $g/m^2$ in terms of wet coating amount.

In addition, the coating amount of the white layer-forming coating liquid used to form the white layer 14 is preferably 5 $g/m^2$ to 30 $g/m^2$, and more preferably 10 $g/m^2$ to 15 $g/m^2$ in terms of wet coating amount.

(Purification of Material)

In the formation of the white layer, the ink accepting layer, the antistatic layer, and the hard coat layer, each layer can be formed by applying and drying an organic solvent or an aqueous dispersion of a composition for forming each layer. In a case where the composition for forming a layer contains impurities, a planar failure called cissing may be generated. In a case where a planar failure is generated, a non-defective rate is lowered, and as a result, productivity of the decorative illumination recording sheet is significantly reduced.

The cissing, that is an aspect of the planar failure of the coating liquid, is a failure that is generated during the course of drying a coating film from when the coating liquid composition is applied to a coating object as the coating film, and refers to a recess that is generated because in a case where a portion having a low surface tension, that is, a contamination portion where impurities exist locally exists at a gas-liquid interface between the coating liquid and the air or a solid-liquid interface between the coating object and the coating liquid composition in the coating liquid composition, the coating liquid composition is repelled around the contamination portion. Examples of the impurities that can cause the cissing include insoluble dust, a small amount of metal atom-containing components derived from a raw material that is used, and a silicone-containing component. Among these, in a case where a silicone-containing component exists, cissing easily occurs. Therefore, a silicone-containing component is particularly preferably removed among impurities contained in the material.

In order to suppress the occurrence of a planar failure, a solution in which a constituent component necessary for layer configuration is dissolved in an organic solvent or a dispersion liquid of a constituent component necessary for layer configuration, that is a coating liquid composition for forming each layer, or a coating liquid composition itself for forming each layer is preferably subjected to a purification step of performing purification through a usual method before a coating step of performing coating.

In the purification step, the purification method is not particularly limited. Examples of the simple purification method include filter filtration, washing, and reprecipitation, and means for purification through filter filtration is preferable. Two or more purification methods may be performed in combination in the purification step.

The method of performing a filter filtration method that is a preferable purification method is not particularly limited. Examples of the filter filtration method include a method of removing impurities by passing a previously prepared coating liquid composition for forming each layer through a filter such as a depth filter or a screen filter formed to include a material selected from polypropylene, glass fiber, polytetrafluoroethylene: TEFLON (registered trademark), and the like.

The purification step for removing impurities may be performed on any layer-forming coating liquid composition. Examples of the coating liquid composition include a white layer-forming coating liquid composition, an ink accepting layer-forming coating liquid composition, an antistatic layer-forming coating liquid composition, and a hard coat layer-forming coating liquid composition. Among these, at least any one of a white layer-forming coating liquid composition or an ink accepting layer-forming coating liquid composition is preferably subjected to the purification step, and a white layer-forming coating liquid composition is more preferably subjected to the purification step from the viewpoint of the effects.

Examples of the purification of a white layer-forming coating liquid composition include the purification of an organic solvent solution of a constituent component that is used to form a white layer, a dispersion liquid of a constituent component that is used to form a white layer, or a white layer-forming coating liquid composition itself. Among these, in a case where a colorant is contained in the white layer, it is effective that the colorant that is used in a white layer-forming coating liquid composition is previously purified through the above-described method.

Taking a white layer-forming coating liquid composition as an example, in a case where a colorant is contained in the white layer-forming coating liquid composition, a white pigment and the colorant may have different particle diameters, and in general, the white pigment has a larger particle diameter than the colorant. Accordingly, in a case where the white layer-forming coating liquid composition itself that contains the colorant is purified through a filter filtration method, a filter having an opening diameter through which the white pigment can pass is used, and thus in a case where the filter filtration is performed under the above-described conditions, the contact efficiency between the colorant having a smaller particle diameter than the white pigment and the filter may be reduced. In a case where a colorant having a smaller particle diameter than the white pigment and containing impurities is used, it is preferable that the colorant is previously purified using a filter having an opening diameter corresponding to the particle diameter of the colorant before the white layer-forming coating liquid composition is prepared from the viewpoint of further improving the purification efficiency.

The method of detecting impurities contained in a coating liquid composition for forming each layer include measuring means such as nuclear magnetic resonance (NMR), X-ray photoelectron spectroscopy (ESCA), and time-of-flight secondary ion mass spectrometry (TOF-SIMS).

The content of impurities contained in a coating liquid composition for forming each layer that has passed through the purification step is preferably 1 ppm or less, and more preferably 0.1 ppm or less. In the impurities, the amount of a silicone-containing component derived from the colorant is preferably not greater than a detection limit with respect to a total amount of the coating liquid composition such as a white layer-forming coating liquid composition in the measurement by the above-described detection method such as X-ray photoelectron spectroscopy from the viewpoint of suppressing the occurrence of cissing.

<<Method of Preparing Decorative Illumination Image Sheet>>

A method of preparing a decorative illumination image sheet according to the present embodiment includes an ink application step of applying an ink composition to the surface of the above-described decorative illumination recording sheet 10 according to the present embodiment.

The surface of the decorative illumination recording sheet 10 refers to an outermost surface of the decorative illumination recording sheet 10 on a side on which the white layer 14 is formed.

As the method of applying an ink composition, a known printing method such as gravure printing, offset printing, or ink jet printing can be applied according to the purpose. In the ink application step, the ink application method may be appropriately selected in consideration of sharpness and resolution that a decorative illumination image to be formed needs, and an area of a decorative illumination image to be formed.

Among these, an ink jet recording method is preferably performed to apply a radiation-curable ink composition suitable for ink jet recording from the viewpoint of efficiently forming a decorative illumination image having a large area.

In a case where a decorative illumination image is formed on the decorative illumination recording sheet 10 according to the present embodiment through an ink jet recording method, a radiation-curable ink composition is used as an ink composition. The ink application step is a step of discharging a radiation-curable ink composition to a surface of a decorative illumination recording sheet through an ink jet method, and may include a curing step of curing the radiation-curable ink composition by irradiating the discharged radiation-curable ink composition with radiation.

As the radiation-curable ink composition that is used in the present embodiment, a known radiation-curable ink composition can be used. The radiation-curable ink composition is particularly preferably a so-called solventless radiation-curable ink composition that does not contain an organic solvent or contains a small amount of an organic solvent such that a liquid polymerizable compound also serves as a liquid medium.

The radiation is not particularly limited, and widely includes α-rays, γ-rays, X-rays, ultraviolet rays, visible light rays, electron beams, and the like. Among these, ultraviolet rays and electron beams are preferable, and ultraviolet rays are particularly preferable from the viewpoint of curing sensitivity and availability of the device. Accordingly, an ultraviolet-curable ink composition is preferable as an ink composition that is used in the formation of a decorative illumination image in the present embodiment.

Regarding the radiation-curable ink composition, for example, the description in JP2010-47015A and JP1993-214280A (JP-H05-214280A) can be referred to.

Regarding the solventless radiation-curable ink composition, for example, the description in JP2004-131725A and JP2009-299057A can be referred to.

The method of preparing a decorative illumination image sheet according to the present embodiment includes the ink application step. Accordingly, through the method of preparing a decorative illumination image sheet according to the present embodiment, it is possible to obtain a decorative illumination image sheet having a decorative illumination ink image obtained by an ink composition cured on a decorative illumination recording sheet.

Examples of the ink jet recording device that can be used in the present embodiment include a device including an ink supply system, a temperature sensor, and an active radiation source.

The ink supply system has, for example, a piezo ink jet head, a storage tank that stores an ink, a supply pipe that supplies an ink from the storage tank to the ink jet head, an ink supply tank, and a filter. The piezo ink jet head can be driven such that multi-size dots of preferably 1 pl (picoliter) to 100 pl, and more preferably 8 pl to 30 pl can be discharged with a resolution of preferably 320×320 dpi (dots per inch) to 4,000×4,000 dpi, more preferably 400×400 dpi to 1,600×1,600 dpi, and even more preferably 720×720 dpi. In the present specification, dpi indicates the number of dots per inch (2.54 cm).

Regarding an ink such as a radiation-curable ink, since an ink to be discharged is desirably kept at a constant temperature, the ink jet recording device is preferably provided with means for stabilizing the ink temperature. The portion that is kept at a constant temperature is from the tank (also including an intermediate tank in a case where the intermediate tank is provided) that stores the ink to a discharge port of the ink jet head. That is, thermal insulation and heating can be performed from the ink supply tank to the ink jet head.

The method of controlling the temperature is not particularly limited. However, for example, a plurality of temperature sensors is preferably provided in the respective pipe portions to control the heating according to the ink flow rate and the environmental temperature. The temperature sensor can be provided near the ink supply tank and the nozzle of the ink jet head. In addition, the head unit to be heated is preferably thermally shut off or insulated such that the main body of the device is not affected by the temperature from outside air. In order to reduce a printer start-up time required for heating, or to reduce a loss of thermal energy, the thermal capacity of the whole heating unit is preferably reduced with thermal insulation against other portions.

The ink is preferably discharged after being heated preferably to 25° C. to 80° C., and more preferably to 25° C. to 50° C. to reduce the viscosity of the ink preferably within a range of 3 mPa·s to 15 mPa·s, and more preferably within a range of 3 mPa·s to 13 mPa·s. Particularly, in the present embodiment, as the ink, an ink having an ink viscosity of 50 mPa·s or less at 25° C. is preferably used since discharge can be satisfactorily performed.

Since the radiation-curable ink composition has a higher viscosity than an aqueous ink that is generally used as a usual ink jet recording ink, the viscosity change due to the temperature change at the time of discharge is large. The change in viscosity of the ink largely affects the change in liquid droplet size and the change in liquid droplet discharge rate, and eventually, image quality deterioration is caused. Therefore, the temperature of the ink at the time of discharge is required to be stably maintained as much as possible. In the present embodiment, the appropriate temperature control width of the ink is preferably a set temperature±5° C., more preferably a set temperature±2° C., and even more preferably a set temperature±1° C.

Next, the curing step of curing an ink by irradiating the ink discharged on a decorative illumination recording sheet with radiation will be described.

The ink discharged on a decorative illumination recording sheet is cured by irradiation with radiation, and a decorative illumination image formed by the cured ink composition is obtained.

In a case where the ink is irradiated with radiation, a radical polymerization initiator contained in the ink is decomposed by radiation irradiation, and thus a radical is generated. In addition, a polymerization reaction of the radical polymerizable compound is carried out and promoted by the generated radical. In a case where a radical polymerization initiator and a sensitizer are present together, the sensitizer in the ink turns into an excited state by absorbing the radiation, and can promote decomposition of the radical polymerization initiator by being brought into contact with the radical polymerization initiator, and thus a curing reaction with higher sensitivity can be achieved.

Here, although depending on the absorption characteristics of the sensitizer, the peak wavelength of the radiation used is, for example, preferably 200 nm to 600 nm, more preferably 300 nm to 450 nm, and even more preferably 350 nm to 420 nm.

In addition, the ink has sufficient sensitivity even to low-power radiation. Accordingly, it is appropriate that curing is performed with an exposed surface illuminance of preferably 10 mW/cm$^2$ to 4,000 mW/cm$^2$, and more preferably 20 mW/cm$^2$ to 2,500 mW/cm$^2$.

As the radiation source, a mercury lamp, a gas or solid laser, or the like is mainly used, and as the light source used for curing the ultraviolet-curable ink jet recording ink, a mercury lamp or a metal halide lamp is widely known. Removal of mercury is strongly desired from the viewpoint of protection of the current environment, and GaN-based semiconductor ultraviolet emission is industrially and environmentally very useful. An ultraviolet light emitting diode (UV-LED) and an ultraviolet laser diode (UV-LD) are preferable from the viewpoint of small size, long lifetime, high efficiency, and low cost.

Particularly, a UV-LED and a UV-LD can be used in a case where an ultraviolet source is required. For example, NICHIA CORPORATION has placed a violet LED, of which the main emission spectrum has a wavelength between 365 nm and 420 nm, on the market. In a case where a shorter wavelength is required, an LED capable of emitting radiation centered on the wavelength between 300 nm and 370 nm, disclosed in U.S. Pat. No. 6,084,250A, is used. Furthermore, other UV-LEDs are available and these can emit radiation of different ultraviolet bands. A UV-LED is a particularly preferable radiation source in the present embodiment, and a UV-LED having a peak wavelength at 350 nm to 420 nm is particularly preferable.

The maximum illuminance of the LED on a decorative illumination recording sheet is preferably 10 mW/cm$^2$ to 2,000 mW/cm$^2$, more preferably 20 mW/cm$^2$ to 1,000 mW/cm$^2$, and particularly preferably 50 mW/cm$^2$ to 800 mW/cm$^2$.

It is appropriate for the ink to be irradiated with radiation preferably for 0.01 seconds to 120 seconds, and more preferably for 0.1 seconds to 90 seconds.

The radiation irradiation conditions and the basic irradiation method are disclosed in JP1985-132767A (JP-S60-132767A). Specifically, a light source is provided on each of both sides of a head unit including an ink discharge device, and the head unit and the light source are scanned by a so-called shuttle method to perform the radiation irradiation. The radiation irradiation is performed after a certain period of time (preferably 0.01 seconds to 0.5 seconds, more preferably 0.01 seconds to 0.3 seconds, and even more preferably 0.01 seconds to 0.15 seconds) since the ink has landed. In a case where the period of time from the landing of the ink to the irradiation is controlled to be an extremely short period of time, it is possible to prevent the ink landed on the decorative illumination recording sheet from spreading before curing.

In addition, the curing may be completed by using another light source unaccompanied by driving. WO99/54415A discloses a method of using an optical fiber and a method of irradiating a recording portion with ultraviolet (UV) light by irradiating a mirror surface provided on a side surface of a head unit with light of a collimated light source. These curing methods can also be applied to the preparation method according to the present embodiment.

The ink jet recording device using an ink jet method preferably uses a wide format ink jet printer system, and more preferably uses a wide format UV ink jet printer system. The wide format ink jet printer system is a system in which the discharge of the ink from the ink jet recording device is performed substantially simultaneously with the irradiation of radiation for curing the discharged ink. Such a system can produce a large-sized printed material in a short period of time. The wide format printer is generally defined as a printer that can perform printing at a width of 24 inches (61 cm) or greater.

Most of such printers perform printing at a width of 44 inches (111.7 cm) to 64 inches (162.5 cm), but some of them can perform printing at a width of up to at most 197 inches (500 cm).

As the wide format UV ink jet printer system, it is possible to use a LuxelJet (registered trademark) UV360 GTW/XTW and UV550 GTW/XTW series and Acuity LED (registered trademark) 1600 (all manufactured by Fujifilm Corporation), inca SP320/SP320e/SP320S/SP320W (manufactured by Inca Digital Printers Limited), and the like.

In the method of preparing a decorative illumination image sheet, an ink set including an ink can be suitably used. For example, it is possible to use an ink set having a combination of a yellow ink, a cyan ink, a magenta ink, and a black ink. In order to obtain a full color image by using the ink, an ink set that is a combination of dark color inks of four colors consisting of yellow, cyan, magenta, and black is preferably used. In addition, an ink set that is a combination of a group of dark color inks of five colors consisting of yellow, cyan, magenta, black, and white and a group of inks of light cyan and light magenta is more preferably used. The "dark color ink" means an ink in which the content of a pigment is greater than 1 mass % with respect to the total amount of the ink.

In order to obtain a color image through the method of preparing a decorative illumination image sheet according to the present embodiment, respective color inks (ink set) are preferably used and superimposed in order from a color with low brightness to a color with high brightness. Specifically, in a case where an ink set composed of inks of yellow, cyan, magenta, and black is used, the inks are preferably applied on the above-described decorative illumination recording sheet according to the present embodiment in order of yellow, cyan, magenta, and black. In a case where an ink set including at least seven colors of inks in total composed of a group of ink compositions of light cyan and light magenta and a group of dark color inks of cyan, magenta, black, white, and yellow is used, the inks are preferably applied on the above-described decorative illumination recording sheet according to the present embodiment in order of white, light cyan, light magenta, yellow, cyan, magenta, and black.

In a case where the inks are superimposed as described above in order from an ink with low brightness to an ink with high brightness, the irradiated radiation easily reaches the ink in the lower portion. Consequently, it is possible to expect good curing sensitivity, reduction of residual monomers, and an improvement in adhesiveness. The irradiation can be performed by discharging all the color inks and exposing them to light at the same time. However, from the viewpoint of promoting the curing, the inks are preferably exposed to light one by one.

<<Decorative Illumination Image Sheet and Decorative Illumination Signboard>>

A decorative illumination image sheet according to the present embodiment includes the above-described decorative illumination recording sheet according to the present embodiment and an ink image.

The decorative illumination image sheet according to the present embodiment is preferably formed by the above-described method of preparing a decorative illumination image sheet according to the present embodiment.

Since the decorative illumination image sheet according to the present embodiment has a decorative illumination image on a decorative illumination recording sheet having a white ground color due to a white pigment, the decorative illumination image can be visually observed as a reflection image during day time with sunlight.

The decorative illumination image sheet according to the present embodiment can be made as a decorative illumination signboard by being installed on a decorative illumination frame provided with a backlight source.

The decorative illumination signboard has a backlight source and a decorative illumination image sheet, and as a decorative illumination image, a decorative illumination image formed by the image forming method according to the present embodiment is installed.

The decorative illumination image is preferably disposed between two types of acrylic resin plates or the like having excellent transparency and weather fastness.

The backlight source is not particularly limited, and for example, any one of a light bulb, a fluorescent lamp, a light emitting diode (LED), an electroluminescent panel (ELP), one or more cold-cathode fluorescent lamps (CCFL), and a hot-cathode fluorescent lamp (HCFL) can be used.

EXAMPLES

Hereinafter, the invention will be described in more detail using examples. The materials, the amounts thereof used, the proportions thereof, the treatment contents, the treatment procedures, and the like shown in the following examples can be appropriately modified within a scope that does not depart from the gist of the invention. Therefore, the scope of the invention is not limited to the following specific examples.

In the following description, "parts" and "%" mean "parts by mass" and "mass %", respectively, unless otherwise specified.

Example 1

[Production of Resin Base]

A polyethylene terephthalate (hereinafter, referred to as "PET") resin polycondensed using an antimony compound as a catalyst was dried such that the moisture content thereof was reduced to 50 ppm or less. The dried PET resin was supplied to an extruder having a heater temperature set to 280° C. to 300° C., and then melted and kneaded. The melted and kneaded PET resin was discharged on an electrostatically charged chill roll from a die portion to obtain an amorphous PET sheet. Next, the obtained amorphous PET sheet was stretched by 3.1 times in a traveling direction (MD; Machine Direction) of the sheet, and then stretched by 3.8 times in a width direction (TD; Transverse Direction) to obtain a PET support (resin base) with a thickness of 180 μm.

[Formation of Colored Layer]

One surface of the PET support as a resin base was subjected to a corona discharge treatment under the condition of 730 J/m$^2$. Then, the surface of the PET support subjected to the corona discharge treatment was coated with the following colored layer-forming coating liquid by a bar coating method. The obtained coating film was dried for 1 minute at 145° C., and thus a colored layer in which a coating amount of a dioxazine pigment that was a violet pigment was 60 mg/m$^2$ was formed.

(Preparation of Colored Layer-Forming Coating Liquid)

Dioxazine Pigment (Pigment Violet 23, manufactured by Dainichiseika Color & Chemicals Mfg. Co., Ltd., TB-1548 VIOLET, aqueous dispersion with solid content of 20%, average primary particle diameter: 0.1 μm): 42.6 parts Polyolefin Resin (manufactured by UNITIKA LTD., ARROWBASE (registered trademark) SE-1013N, aqueous dispersion with solid content of 20%): 309.1 parts Surfactant (manufactured by FUJIFILM Finechemicals Co., Ltd., sodium=bis(3,3,4,4,5,5,6,6-nonafluoro)=2-sulfoniteoxysuccinate, solution with solid content of 2%): 4.0 parts Distilled Water: The amount thereof was adjusted such that the total mass of the colored layer-forming coating liquid became 1,000 parts.

[Formation of White Layer and Ink Accepting Layer]

A surface of the colored layer (a surface of the colored layer on a side opposite to the resin base) was subjected to a corona discharge treatment under the condition of 730 J/m$^2$, and then coated with the following coating liquid A by a bar coating method. The coating film of the coating liquid A coated on the surface of the colored layer formed on the PET support was dried for 1 minute at 145° C., and thus a white layer with a thickness of 15.0 μm in which a coating amount of a white pigment was 2.6 g/m$^2$ was formed on the surface of the colored layer formed on one surface of the PET support.

After a corona discharge treatment was performed under the condition of 288 J/m$^2$ on a surface of the white layer formed on one surface of the PET support, the following coating liquid B was applied by a bar coating method. The coating film of the coating liquid B coated on the surface of the white layer was dried for 1 minute at 160° C., and thus an ink accepting layer with a thickness of 0.4 μm was formed on the white layer.

[Preparation of Coating Liquid a (White Layer-Forming Coating Liquid)]

(Preparation of Titanium Dioxide Dispersion Liquid)

A mixture obtained by mixing components of the following composition of a titanium dioxide dispersion liquid was subjected to a dispersion treatment for 1 hour using a dyno mill-type disperser.

(Composition of Titanium Dioxide Dispersion Liquid)

Titanium Dioxide (white pigment: TIPAQUE (registered trademark) CR-95, manufactured by ISHIHARA SANGYO KAISHA, LTD., solid content: 100%, average primary particle diameter: 0.3 μm): 456.0 parts Polyvinyl Alcohol (PVA-105, manufactured by KURARAY CO., LTD., aqueous solution with solid content of 10%): 233.0 parts Surfactant (DEMOL (registered trademark) EP, manufactured by Kao Corporation, aqueous solution with solid content of 25%): 5.6 parts Preservative (manufactured by DAITO CHEMICAL CO., LTD., 1,2-benzothiazoline-3-one, methanol solvent with solid content of 3.5 mass %): 3.1 parts Distilled Water: The amount thereof was adjusted such that the total mass of the titanium dioxide dispersion liquid became 1,000 parts.

(Composition of Coating Liquid A)

The composition of the coating liquid A is as follows.

Titanium Dioxide Dispersion Liquid Prepared in Above Description: 45.4 parts Vinyl Chloride Resin (manufactured by Nisshin Chemical Co., Ltd., VINYBLAN 278, aqueous dispersion with solid content of 43%): 207.4 parts Cross-linking Agent (oxazoline compound, manufactured by NIPPON SHOKUBAI CO. LTD EPOCROS (registered trademark) WS-700, aqueous solution with solid content of 25%): 88.6 parts Catalyst (manufactured by Nippon Chemical Industrial CO., LTD., 35% aqueous solution of secondary ammonium phosphate for food additive): 6.9 parts Colloidal Silica (manufactured by NISSAN CHEMICAL INDUSTRIES, LTD., SNOWTEX (registered trademark) C, aqueous dispersion with solid content of 20%, average primary particle diameter: 20 nm): 95.0 parts Distilled Water: The amount thereof was adjusted such that the total mass of the coating liquid A became 1,000 parts.

[Preparation of Coating Liquid B (Ink Accepting Layer-Forming Coating Liquid)]

Components of the following composition of the coating liquid B were mixed, and thus the coating liquid B was prepared.

The composition of the coating liquid B is as follows.

Polyester Resin (manufactured by GOO CHEMICAL CO., LTD., PLASCOAT (registered trademark) Z592, aqueous dispersion with solid content of 25%): 118.0 parts Polyurethane Resin (manufactured by DKS Co., Ltd., SUPERFLEX (registered trademark) 150HS, aqueous dispersion with solid content of 38%): 77.6 parts Cross-linking Agent (manufactured by NIPPON SHOKUBAI CO., LTD., EPOCROS K-2020E, diluted to have solid content concentration of 20%): 10.5 parts Anionic Surfactant (1% aqueous solution of RAPISOL (registered trademark) A-90 manufactured by NOF CORPORATION): 16.91 parts Lubricant (manufactured by CHUKYO YUSHI CO., LTD., carnauba wax dispersion CELLOSOL 524, solid content: 3%): 23.2 parts Nonionic Surfactant (manufactured by Sanyo Chemical Industries, Ltd., 1% aqueous solution of NAROACTY (registered trademark) CL-95): 40.87 parts Preservative (manufactured by DAITO CHEMICAL CO., LTD., 1,2-benzothiazoline-3-one, methanol solvent with solid content of 3.5%): 1.0 parts Distilled Water: The amount thereof was adjusted such that the total mass of the coating liquid B became 1,000 parts.

[Formation of Antistatic Layer]

A rear surface (a surface of the PET support on a side opposite to the surface on which the white layer and the ink accepting layer are formed) of the PET support (resin base) was subjected to a corona discharge treatment under the condition of 310 J/m$^2$, and then coated with the following coating liquid for an antistatic layer by a bar coating method. The coating amount of the coating liquid for an antistatic layer was 8.4 cm$^3$/m$^2$. The coating film of the coating liquid for an antistatic layer coated on the other surface of the PET support was dried for 1 minute at 145° C. to form an antistatic layer containing a metal oxide with an average thickness of about 0.1 μm.

(Coating Liquid for Antistatic Layer)

The composition of the coating liquid for an antistatic layer is as follows.

Self-Cross-linking Polyurethane Resin (manufactured by Mitsui Chemicals, Inc., TAKELAC (registered trademark) WS-5100, solid content: 30%): 31.5 parts Aqueous Dispersion of Tin Dioxide Doped with Antimony (needle shape) (manufactured by ISHIHARA SANGYO KAISHA, LTD., FS-10D, solid content: 20%): 43.7 parts Surfactant (manufactured by Sanyo Chemical Industries, Ltd., 10% aqueous solution of SANDEDDO (registered trademark) BL, anionic): 2.1 parts Surfactant (manufactured by Sanyo Chemical Industries, Ltd., 1% aqueous solution of NAROACTY (registered trademark) CL-95, nonionic): 21.0 parts Distilled Water: The amount thereof was adjusted such that the total mass of the coating liquid for an antistatic layer became 1,000 parts.

[Formation of Hard Coat Layer]

The antistatic layer formed on the rear surface of the PET support was subjected to a corona discharge treatment under the condition of 200 J/m$^2$, and then coated with the following hard coat layer-forming coating liquid by a bar coating method. The coating amount of the coating liquid for a hard coat layer was 13.8 cm$^3$/m$^2$. The coating film of the hard coat layer-forming coating liquid coated on the upper surface of the antistatic layer formed on the rear surface of the PET support was dried for 1 minute at 145° C. to form a hard coat layer with an average thickness of about 0.85 μm, and a decorative illumination recording sheet according to Example 1 was produced.

(Preparation of Hard Coat Layer-Forming Coating Liquid)

The following components were used in order to prepare the hard coat layer-forming coating liquid.

Acetic Acid Aqueous Solution (manufactured by Daicel Corporation, 1% aqueous solution of industrial acetic acid): 402.0 parts 3-Glycidoxypropyltriethoxysilane (manufactured by Shin-Etsu Chemical Co., Ltd., KBE-403): 110.0 parts Tetraethoxysilane (manufactured by Shin-Etsu Chemical Co., Ltd., KBE-04): 127.6 parts Curing Agent (manufactured by Kawaken Fine Chemicals Co., Ltd., ALUMINUM CHELATE A(W)): 1.3 parts Surfactant A (manufactured by Sanyo Chemical Industries, Ltd., 10% aqueous solution of SANDEDDO (registered trademark) BL, anionic): 14.7 parts Surfactant B (manufactured by Sanyo Chemical Industries, Ltd., 1% aqueous solution of NAROACTY (registered trademark) CL-95, nonionic): 40.9 parts Acrylic Resin Particles (manufactured by Soken Chemical & Engineering Co., Ltd., MX-150, average primary particle diameter: 1.5 μm): 9.2 parts Acrylic Resin Particles (manufactured by Soken Chemical & Engineering Co., Ltd., MX-80H3WT, average primary particle diameter: 0.8 μm): 9.2 parts Aqueous Dispersion of Polystyrene Resin Particles (manufactured by ZEON Corporation, Nipol (registered trademark) UFN1008, solid content: 20%, average primary particle diameter: 1.9 μm): 6.9 parts Distilled Water: The amount thereof was adjusted such that the total mass of the coating liquid for a hard coat layer became 1,000 parts.

Using the above-described components, the hard coat layer-forming coating liquid was prepared by the following method.

While an acetic acid aqueous solution was strongly stirred in a constant-temperature tank at 25° C., 3-glycidoxypropyltriethoxysilane was added dropwise over 3 minutes. After the dropwise addition was terminated, the stirring was continued for 1 hour, and then a tetraethoxysilane was added over 5 minutes to the acetic acid aqueous solution in the constant-temperature tank at 30° C. while being strongly stirred. After the addition was terminated, the stirring was continued for 2 hours. Cooling to 10° C. was performed over 1 hour. The obtained aqueous solution was defined as an aqueous solution X.

Separately, a curing agent, surfactants A and B, distilled water, and three types of resin particles were mixed, and the mixed liquid was subjected to ultrasonic dispersion for 5 minutes. The obtained resin particle dispersion liquid was defined as an aqueous solution Y.

The aqueous solution Y and distilled water were added to the aqueous solution X in order, and then cooled until the liquid temperature was 10° C. Thus, a hard coat layer-forming coating liquid was obtained.

Example 2

A decorative illumination recording sheet was produced in the same manner as in Example 1, except that the vinyl chloride resin used for forming the white layer was replaced with the following acrylic resin such that the content of the acrylic resin was 250 parts.

Acrylic Resin: (manufactured by DAICEL FINECHEM LTD., AS-563A, aqueous dispersion with solid content of 28%)

Example 3

A coating liquid C having the following composition was prepared as a white layer-forming coating liquid in the same manner as in the case of the coating liquid A in Example 1, and used to form a white layer.

In Example 1, one surface of a PET support was subjected to a corona discharge treatment under the condition of 730 J/m$^2$ with no colorant layer on the resin base, and then coated with the following coating liquid C by a bar coating method. The obtained coating film was dried for 1 minute at 145° C. to form, on one surface of the PET support, a white layer with a thickness of 12 μm in which a coating amount of a white pigment was 2.3 g/m$^2$ and a coating amount of a dioxazine pigment was 5 mg/m$^2$.

After the formation of the white layer, a decorative illumination recording sheet of Example 3 was produced in the same manner as in Example 1.

(Coating Liquid C: Composition)

Titanium Dioxide Dispersion Liquid Prepared in the Same Manner as in Example 1: 46.5 parts Dioxazine Pigment (Pigment Violet 23, manufactured by Dainichiseika Color & Chemicals Mfg. Co., Ltd., TB-1548 VIOLET, aqueous dispersion with solid content of 20%, average primary particle diameter: 0.1 μm): 0.25 parts Acrylic Resin (manufactured by DAICEL FINECHEM LTD., AS-563A, aqueous dispersion with solid content of 28%): 250.0 parts Cross-linking Agent (oxazoline compound, manufactured by NIPPON SHOKUBAI CO., LTD., EPOCROS (registered trademark) WS-700, aqueous solution with solid content of 25%): 112.5 parts Catalyst (manufactured by Nippon Chemical Industrial CO., LTD., 35% aqueous solution of secondary ammonium phosphate for food additive): 8.8 parts Colloidal Silica (manufactured by NISSAN CHEMICAL INDUSTRIES, LTD., SNOWTEX (registered trademark) C, aqueous dispersion with solid content of 20%, average primary particle diameter: 20 nm): 119.4 parts Surfactant (manufactured by FUJIFILM Finechemicals Co., Ltd., sodium=bis(3,3,4,4,5,5,6,6-nonafluoro)=2-sulfoniteoxysuccinate, solution with solid content of 2%): 4.0 parts Distilled Water: The amount thereof was adjusted such that the total mass of the coating liquid C became 1,000 parts.

Examples 4 to 18 and Comparative Example 1

Decorative illumination recording sheets of Examples 4 to 18 and Comparative Example 1 were produced in the same manner as in Example 3, except that the content ratios of components described in the following Tables 1 to 3 were changed to content ratios described in Tables 1 to 3.

The contents of two types of resins contained in each of the ink accepting layer and the white layer in Tables 1 to 3 will be described. In the ink accepting layer, a polyester resin and a polyurethane resin are contained as two types of resins, and the content ratio between the polyester resin and the polyurethane resin is 50:50 in terms of a mass ratio. In the white layer, a polyolefin resin and an acrylic resin are contained as two types of resins, and the content ratio between the polyolefin resin and the acrylic resin is 30:70 in terms of a mass ratio.

Details of the components described in the following Tables 1 to 3 are as follows.

(Resin)

Vinyl Chloride Resin (manufactured by Nisshin Chemical Co., Ltd., VINYBLAN 278, aqueous dispersion with solid content of 43%)

Acrylic Resin (manufactured by DAICEL FINECHEM LTD., AS-563A, aqueous dispersion with solid content of 28%)

Polyester Resin (manufactured by GOO CHEMICAL CO., LTD., PLASCOAT (registered trademark) Z592, aqueous dispersion with solid content of 25%)

Polyolefin Resin (manufactured by UNITIKA LTD., ARROWBASE (registered trademark) SE-1013N, aqueous dispersion with solid content of 20%)

The content ratio between a polyolefin resin and an acrylic resin in Examples 9 to 18 is 30:70 based on the mass.

(Colorant)

Dioxazine Pigment (violet pigment: Pigment Violet 23, manufactured by Dainichiseika Color & Chemicals Mfg. Co., Ltd., TB-1548 VIOLET, aqueous dispersion with solid content of 20%, average primary particle diameter: 0.1 μm)

Copper Phthalocyanine (blue pigment: Phthalocyanine Blue, Pigment Blue 15, manufactured by Dainichiseika Color & Chemicals Mfg. Co., Ltd., EP700 BLUE GA, aqueous dispersion with solid content of 35%, average primary particle diameter: 0.1 μm)

Cobalt Green (green pigment: Pigment Green 50, composition: Co—Zn—Ni—Ti oxide, manufactured by Dainichiseika Color & Chemicals Mfg. Co., Ltd., MF-5363 Green, aqueous dispersion with solid content of 62%, average primary particle diameter: 0.1 μm)

The content ratio between copper phthalocyanine and cobalt green in Examples 15 and 16 is 67:33 based on the mass. The content ratio between copper phthalocyanine and a dioxazine pigment in Examples 17 and 18 is 33:67 based on the mass.

As the dispersion liquid of the colorant used in the examples and the comparative examples, a dispersion liquid of a colorant that was subjected to filter filtration including passing through a filter twice using a depth filter (1 μm, PROFILE II) manufactured by NIHON PALL LTD., and was confirmed to be a liquid in which the amount of a silicone-containing component as impurities is not greater than a detection limit in the measurement by X-ray photoelectron spectroscopy (ESCA: manufactured by Kratos Analytical Ltd., AXIS-HSi) was used (purification step).

Comparative Example 2

A transparent decorative illumination recording sheet of Comparative Example 2 was produced in the same manner as in Example 3, except that a transparent coating liquid D, that was the following composition containing no white pigment, was used in place of the coating liquid C used as a white layer-forming coating liquid to form a transparent layer with a thickness of 0.5 μm on the resin base.

(Preparation of Coating Liquid D (Transparent Layer-Forming Coating Liquid))

The coating liquid D was prepared by mixing components shown in the following composition.

(Coating Liquid D: Composition)

Acrylic Acid Resin (manufactured by TOAGOSEI CO., LTD., JURYMER ET-410, solid content: 30%): 63.4 parts Polyolefin Resin (manufactured by UNITIKA LTD., ARROWBASE SE-1013N, solid content: 20 mass %): 95.1 parts Cross-linking Agent (manufactured by Nisshinbo Holdings Inc., CARBODILITE V-02-L2, solid content: 40%): 31.5 parts Surfactant A (1% aqueous solution of NAROACTY CL-95 manufactured by Sanyo Chemical Industries, Ltd.): 16.7 parts Surfactant B (1% aqueous solution of RAPISOL B-90 manufactured by NOF CORPORATION): 6.9 parts Aqueous Polystyrene Latex Dispersion (manufactured by ZEON Corporation, Nipol UFN1008, solid content: 20%, average primary particle diameter: 1.9 μm): 1.2 parts Preservative (manufactured by DAITO CHEMICAL CO., LTD., 1,2-benzothiazoline-3-one, methanol solvent with solid content of 3.5%): 0.8 parts Distilled Water: The amount thereof was adjusted such that the total mass of the coating liquid D became 1,000 parts.

Comparative Examples 3 to 5

A decorative illumination recording sheet, that is Example 1 described in JP2014-144578A, in which Tv was 37.9 and that included, as a white layer, an undercoat layer containing calcium carbonate and a yellow pigment EMACOL NS YELLOW 4618 (solid content concentration: 25 mass %) (trade name) manufactured by Sanyo Color Works, LTD. and having a thickness of 25 μm was formed and used as Comparative Example 3. A decorative illumination recording sheet, that is Example 2 described in JP2014-144578A, in which the content of the yellow pigment was smaller than that in Comparative Example 3, the thickness was 20 μm, and Tr was 54.2 was formed and evaluated as Comparative Example 4, and a decorative illumination recording sheet, that is Example 3 described in JP2014-144578A, in which the content of the yellow pigment was larger than that in Comparative Example 3, the thickness was 60 μm, Tv was 21.0, and Tr was 26.5 was formed and evaluated as Comparative Example 5.

Comparative Examples 6 and 7

A commercially available product A (trade name: KODAK PROFESSIONAL UV-Curable Display Film-Plus, medium for ultraviolet-curable ink, manufactured by Eastman Kodak Company), that is a commercially available decorative illumination recording sheet, was used as Comparative Example 6.

A commercially available product B (trade name: NH-308, medium for ultraviolet-curable ink, manufactured by KIMOTO CO., LTD.), that is a commercially available decorative illumination recording sheet, was used as Comparative Example 7.

[Evaluation of Decorative Illumination Recording Sheet]

(Measurement of Average Transmittance)

Using a device in which an integrating sphere attachment device ARV-474 was attached to a spectrophotometer V-560 (manufactured by JASCO Corporation), a diffuse transmittance of the decorative illumination recording sheet with respect to light with a wavelength of 300 nm to 800 nm was measured. An average transmittance (Tv) in a wavelength range of 400 nm to 700 nm and an average transmittance (Tr) in a wavelength range of 701 nm to 800 nm were measured for each decorative illumination recording sheet. The measurement was performed under the condition that light entered from the resin base on a side opposite to the side having the white layer. Regarding measurement conditions, air blank measurement (base line) was performed in a transmittance measurement mode of the above-described spectrophotometer. The measurement was performed at a measurement wavelength of 300 nm to 800 nm with a bandwidth of 5 nm, medium response, and a scanning rate of 400 nm/min. As the average transmittance, a simple average value obtained by adding transmittance data obtained in a target wavelength range together and dividing the resulting sum by the number of data was employed.

The results are shown in the following Tables 1 to 3.

(Evaluation of Image Brightness)

The image brightness depends on the transmittance of visible light. Accordingly, the evaluation was performed according to the following evaluation standard, based on the light transmittance in a wavelength range of 400 nm to 700 nm in the above-described measurement.

In the following evaluation standard, A to C were evaluated as acceptable levels in practical use, and D and E were evaluated as unacceptable levels in practical use.

<Evaluation Standard>

A: Tv≥4%

B: 42%≤Tv<44%

C: 40%≤Tv<42%

D: 35%≤Tv<40%

E: Tv<35%

[Visual Evaluation of Show-Through of Light Source Image]

Ten expert panelists visually evaluated show-through of a light source image.

The obtained decorative illumination recording sheet was set in an LED internal lighting panel (FE999, manufactured by Belc CO., LTD.) in which an acrylic opaque panel was detached therefrom, and visually observed from a place separated by 2 m from the decorative illumination sheet to evaluate the degree of visual confirmation of a light source image according to the following evaluation standard. The largest number obtained in the evaluation of ten expert panelists was used as an evaluation result. The results are shown in the following Tables 1 to 3.

In the following evaluation standard, A to C were evaluated as acceptable levels in practical use, and D and E were evaluated as unacceptable levels in practical use.

<Evaluation Standard>

A: Brightness unevenness caused by the light source cannot be visually confirmed.

B: Slight brightness unevenness caused by the light source is visually confirmed, but the number of the light sources cannot be counted.

C: Slight brightness unevenness caused by the light source is recognized, and the number of the light sources can be counted due to the brightness unevenness.

D: Brightness unevenness caused by the light source is clearly recognized, and the outline of the LED light source can be visually confirmed.

E: Brightness unevenness caused by the light source is clearly recognized, and the outline of the light source and the center portion of the light source can be visually confirmed.

Figure 3:
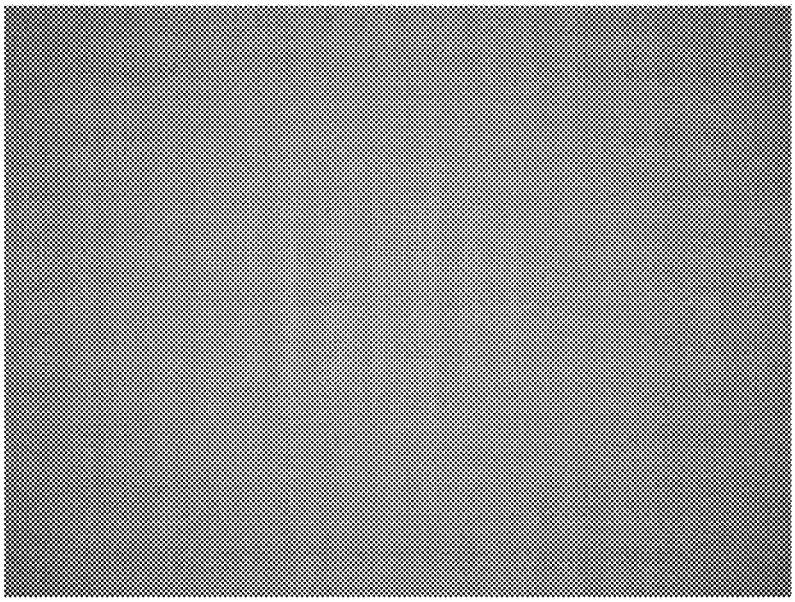
FIG. 3 is a photograph of LED light sources taken through a decorative illumination recording sheet of Example 15.
Figure 4:
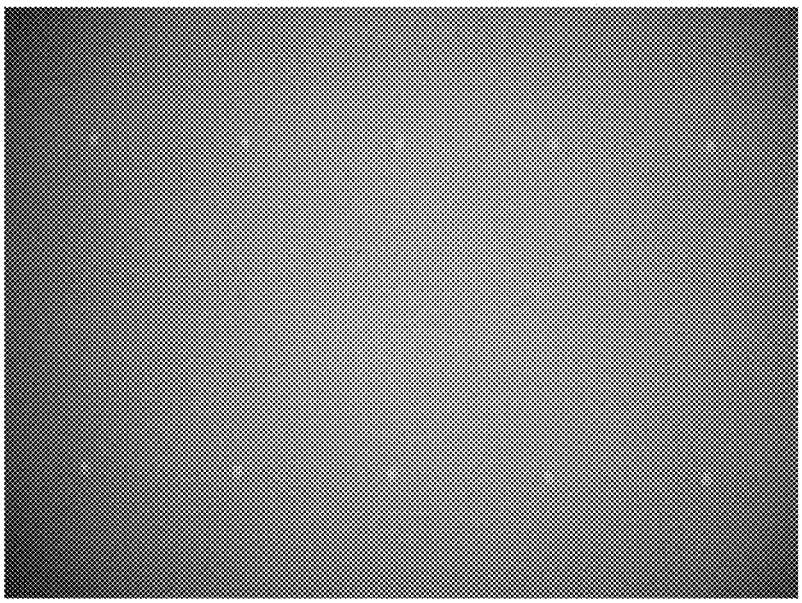
FIG. 4 is a photograph of LED light sources taken through a decorative illumination recording sheet of Comparative Example 6.

FIG. 3 is an optical photograph of an LED internal lighting panel that is an observation object of Example 15, and FIG. 4 is an optical photograph of an LED internal lighting panel that is an observation object of Comparative Example 6. It is found that as shown in FIG. 3, at the evaluation level A, no LED light source is visually confirmed through the decorative illumination recording sheet, but as shown in FIG. 4, at the evaluation level D, LED light source images can be clearly visually confirmed.

[Evaluation of Decorative Illumination Recording Sheet (Decorative Illumination Image Sheet) after Formation of Decorative Illumination Image]

(Production of Decorative Illumination Image)

The obtained decorative illumination recording sheets of Examples 1 to 18 and decorative illumination recording sheets of Comparative Examples 1 to 7 were used to print a color image on a surface of the ink accepting layer of each decorative illumination recording sheet through an ink jet recording method under the following conditions, and thus decorative illumination image sheets having an ink image on the decorative illumination recording sheet were produced.

As inks, solventless radiation-curable inks (manufactured by FUJIFILM Speciality Ink System Limited, Product Nos. UVIJET KO 021 White, UVIJET KO 004 Black, UVUET KO 215 Cyan, UVUET KO 867 Magenta, UVIJET KO 052 Yellow) were used.

As a printer, a "wide format UV ink jet press LuxelJet (registered trademark) UV550GTW, manufactured by Fujifilm Corporation", was used, and a color image was printed twice on each decorative illumination recording sheet (at a wavelength of 365 nm to 405 nm and a printing speed of 22 $m^2$/hr) to obtain a decorative illumination image sheet having a decorative illumination image with a size of about 2 m×1.5 m.

(Color Evaluation of Decorative Illumination Image)

Each of the produced decorative illumination image sheets was subjected to color evaluation with the following evaluation method and evaluation standard.

The obtained decorative illumination image sheet was set in an LED internal lighting panel (FE999, manufactured by Belc CO., LTD.) in which an acrylic opaque panel was detached therefrom, and tint of transmission light of a portion having no image printed thereon was evaluated using a spectral colorimeter (CM-700d, manufactured by Konica Minolta, Inc.).

Regarding measurement conditions, L*a*b* was measured in a SCI mode with a field of view of 10° using a light source D65 based on an average value of three times of measurement, and the evaluation was performed according to the following evaluation standard.

In the following evaluation standard, A to C were evaluated as acceptable levels in practical use, and D and E were evaluated as unacceptable levels in practical use.

(Evaluation Standard)

A: $-4.0 \leq b^* < -3.0$

B: $-6.0 \leq b^* < -4.0$ or $-3.0 \leq b^* - 2.0$

C: $-8.0 \leq b^* < -6.0$ or $-2.0 \leq b^* < -1.0$

D: $-10.0 \leq b^* < -8.0$ or $-1.0 \leq b^* < 0$

E: Ranging within values out of the ranges of A to D

The results are shown in Tables 1 to 3.

TABLE 1

| | Configuration of Decorative Illumination Recording Sheet | | | | | | | | Evaluation Results | | | | |
|---|---|---|---|---|---|---|---|---|---|---|---|---|---|
| | White Layer | | | | | Colored Layer | | | Average Transmittance [%] | | | | |
| | Binder | White Pigment [g/m²] | Colorant Type | Colorant [mg/m²] | Film Thickness [μm] | Colorant Type | Colorant [mg/m²] | Binder | Tv 400 to 700 | Tr 701 to 800 | Image Brightness | LED Show-Through | Image Color |
| EXAMPLE 1 | Vinyl Chloride Resin | 2.6 | — | — | 15.0 | Dioxazine | 60.0 | Polyolefin Resin | 41.0 | 48.0 | C | B | C |
| EXAMPLE 2 | Acrylic Resin | 2.6 | — | — | 15.0 | Dioxazine | 60.0 | Polyolefin Resin | 42.1 | 49.5 | B | C | B |
| EXAMPLE 3 | Acrylic Resin | 2.3 | Dioxazine | 5 | 12.0 | — | — | | 43.1 | 49.2 | B | C | A |
| EXAMPLE 4 | Acrylic Resin | 2.3 | Dioxazine | 5 | 8.0 | — | — | — | 43.5 | 47.5 | B | A | B |

TABLE 1-continued

| | Configuration of Decorative Illumination Recording Sheet | | | | | | | | Evaluation Results | | | | |
|---|---|---|---|---|---|---|---|---|---|---|---|---|---|
| | White Layer | | | | | Colored Layer | | | Average Transmittance [%] | | | | |
| | Binder | White Pigment [g/m$^2$] | Colorant Type | Colorant [mg/m$^2$] | Film Thickness [μm] | Colorant Type | Colorant [mg/m$^2$] | Binder | Tv 400 to 700 | Tr 701 to 800 | Image Brightness | LED Show-Through | Image Color |
| EXAMPLE 5 | Acrylic Resin | 2.3 | Dioxazine | 5 | 0.6 | — | — | — | 43.4 | 47.3 | B | A | B |
| EXAMPLE 6 | Acrylic Resin | 2.3 | Dioxazine | 5 | 0.4 | — | — | — | 43.7 | 48.5 | B | B | B |
| EXAMPLE 7 | Polyester Resin | 2.3 | Dioxazine | 5 | 3.0 | — | — | — | 43.1 | 47.4 | B | A | B |
| EXAMPLE 8 | Polyolefin Resin | 2.3 | Dioxazine | 5 | 3.0 | — | — | — | 42.6 | 47.8 | B | A | B |
| EXAMPLE 9 | Polyolefin Resin/Acrylic Resin | 2.3 | Dioxazine | 0.4 | 3.0 | — | — | — | 44.2 | 49.5 | A | C | B |
| EXAMPLE 10 | Polyolefin Resin/Acrylic Resin | 2.3 | Dioxazine | 0.6 | 3.0 | — | — | — | 43.2 | 47.5 | B | B | B |

TABLE 2

| | Configuration of Decorative Illumination Recording Sheet | | | | | | | | Evaluation Results | | | | |
|---|---|---|---|---|---|---|---|---|---|---|---|---|---|
| | White Layer | | | | | Colored Layer | | | Average Transmittance [%] | | | | |
| | Binder | White Pigment [g/m$^2$] | Colorant Type | Colorant [mg/m$^2$] | Film Thickness [μm] | Colorant Type | Colorant [mg/m$^2$] | Binder | Tv 400 to 700 | Tr 701 to 800 | Image Brightness | LED Show-Through | Image Color |
| EXAMPLE 11 | Polyolefin Resin/Acrylic Resin | 2.3 | Dioxazine | 45 | 3.0 | — | — | — | 42.4 | 47.4 | B | A | B |
| EXAMPLE 12 | Polyolefin Resin/Acrylic Resin | 2.3 | Dioxazine | 55 | 3.0 | — | — | — | 43.5 | 47.2 | B | A | C |
| EXAMPLE 13 | Polyolefin Resin/Acrylic Resin | 2.3 | Copper Phthalocyanine | 5 | 3.0 | — | — | — | 44.5 | 47.8 | A | A | B |
| EXAMPLE 14 | Polyolefin Resin/Acrylic Resin | 2.3 | Cobalt Green | 5 | 3.0 | — | — | — | 44.2 | 47.4 | A | A | B |
| EXAMPLE 15 | Polyolefin Resin/Acrylic Resin | 2.3 | Copper Phthalocyanine | 2 | 3.0 | — | — | — | 44.8 | 47.9 | A | A | A |
| EXAMPLE 16 | | | Cobalt Green | 3 | | | | | | | | | |
| EXAMPLE 17 | Polyolefin Resin/Acrylic Resin | 2.3 | Copper Phthalocyanine | 2 | 3.0 | — | — | — | 44.2 | 47.8 | A | A | A |
| EXAMPLE 18 | | | Cobalt Green | 3 | | | | | | | | | |

TABLE 3

| | Configuration of Decorative Illumination Recording Sheet | | | | | | | | Evaluation Results | | | | |
|---|---|---|---|---|---|---|---|---|---|---|---|---|---|
| | White Layer | | | | | Colored Layer | | | Average Transmittance [%] | | | | |
| | Binder | White Pigment [g/m$^2$] | Colorant Type | Colorant [mg/m$^2$] | Film Thickness [μm] | Colorant Type | Colorant [mg/m$^2$] | Binder | Tv 400 to 700 | Tr 701 to 800 | Image Brightness | LED Show-Through | Image Color |
| COMPARATIVE EXAMPLE 1 | Vinyl Chloride Resin | 2.3 | — | — | 20.0 | — | — | — | 45.5 | 51.2 | A | D | D |
| COMPARATIVE EXAMPLE 2 | Polyolefin Resin/Acrylic Resin | — — | (Transparent Layer Containing No White Pigment) | | 0.5 | — | — | — | 81.1 | 89.4 | A | E | — |
| COMPARATIVE EXAMPLE 3 | Decorative Illumination Recording Sheet of Example 1 of JP2014-144578A | | | | | | | | 37.9 | 45.2 | D | A | D |
| COMPARATIVE EXAMPLE 4 | Decorative Illumination Recording Sheet of Example 2 of JP2014-144578A | | | | | | | | 48.5 | 54.2 | A | E | D |
| COMPARATIVE EXAMPLE 5 | Decorative Illumination Recording Sheet of Example 3 of JP2014-144578A | | | | | | | | 21.0 | 26.5 | E | A | D |
| COMPARATIVE EXAMPLE 6 | Decorative Illumination Recording Sheet: Commercially Available Product A | | | | | | | | 44.5 | 51.5 | A | D | B |
| COMPARATIVE EXAMPLE 7 | Decorative Illumination Recording Sheet: Commercially Available Product B | | | | | | | | 31.9 | 38.1 | E | A | D |

From Tables 1 to 3, it is found that in all of the cases of the decorative illumination image sheets using the decorative illumination recording sheet of the example, both of the prevention of show-through of an LED light source image and the brightness of a decorative illumination signboard using the decorative illumination recording sheet are satisfied. In addition, from the comparison of Example 2 with Examples 3 to 6, it is found that in a case where the colorant is contained in the same white layer as the white pigment, the effects of the present embodiment are obtained even in a case where the content of the colorant is reduced. In addition, it is found that both of the prevention of show-through of a light source image and the brightness of an image are satisfied at a higher level in a case where the thickness of the white layer is 0.5 μm or greater and less than 10 μm.

The disclosure of JP2015-061707 filed on Mar. 24, 2015, is, in its entirety, incorporated by reference in the present specification.

All of the documents, patent applications and technical standards mentioned in the present specification are incorporated by reference into the present specification to the same extent as if such individual document, patent application or technical standard was specifically and individually indicated to be incorporated by reference.

What is claimed is:

1. A decorative illumination recording sheet comprising:

a resin base;

a white layer that is disposed on the resin base and contains a white pigment and a binder; and a colorant different from the white pigment, wherein, in a case in which an average transmittance in a wavelength range of 400 nm to 700 nm is represented by Tv, and an average transmittance in a wavelength range exceeding 700 nm, but not exceeding 800 nm, is represented by Tr, Tv and Tr satisfy relationships expressed by the following Formulae (1) and (2):

$$40.0\% \leq Tv < 50.0\% \quad (1)$$

$$40.0\% \leq Tr < 50.0\% \quad (2).$$

2. The decorative illumination recording sheet according to claim 1, wherein the colorant different from the white pigment is contained in the white layer.

3. The decorative illumination recording sheet according to claim 1, wherein the content of the colorant different from the white pigment in the decorative illumination recording sheet is 0.5 mg/m$^2$ or greater and less than 50.0 mg/m$^2$.

4. The decorative illumination recording sheet according to claim 1, wherein the content of the colorant different from the white pigment in the decorative illumination recording sheet is 1.0 mg/m$^2$ or greater and less than 10.0 mg/m$^2$.

5. The decorative illumination recording sheet according to claim 1, wherein the colorant different from the white pigment includes at least one colorant selected from the group consisting of a phthalocyanine pigment, a dioxazine pigment, and a cobalt oxide pigment.

6. The decorative illumination recording sheet according to claim 1, wherein the binder contained in the white layer includes at least one selected from the group consisting of a polyolefin resin, a polyester resin, and an acrylic resin.

7. The decorative illumination recording sheet according to claim 1, wherein the white layer has a thickness of 0.5 μm or greater and less than 10 μm.

8. The decorative illumination recording sheet according to claim 1, which is for ink jet recording.

9. The decorative illumination recording sheet according to claim 1, further comprising:

an ink accepting layer on the white layer disposed on the resin base.

10. A method of manufacturing a decorative illumination image sheet comprising:

applying an ink composition to a surface of the decorative illumination recording sheet according to claim 1.

11. The method of manufacturing a decorative illumination image sheet according to claim 10, wherein:

the ink composition is a radiation-curable ink composition, and applying an ink composition is discharging the radiation-curable ink composition to the surface of the decorative illumination recording sheet by an ink jet method; and the method further comprises curing the radiation-curable ink composition by irradiating the discharged radiation-curable ink composition with radiation.

12. A decorative illumination image sheet comprising:

the decorative illumination recording sheet according to claim 1; and an ink image.

13. A decorative illumination signboard comprising:

a light emitting diode light source; and the decorative illumination image sheet according to claim 12.

14. A method of manufacturing a decorative illumination recording sheet comprising:

forming a white layer by applying a white layer-forming coating liquid containing a white pigment and a binder to at least one side of a resin base; and adjusting, in a case where an average transmittance in a wavelength range of 400 nm to 700 nm is represented by Tv, and an average transmittance in a wavelength range exceeding 700 nm, but not exceeding 800 nm, is represented by Tr, Tv and Tr within a range satisfying relationships expressed by the following Formulae (1) and (2) using a colorant different from the white pigment:

$$40.0\% \leq Tv < 50.0\% \quad (1)$$

$$40.0\% \leq Tr < 50.0\% \quad (2).$$

15. The method of manufacturing a decorative illumination recording sheet according to claim 14, further comprising:

forming an ink accepting layer by applying an ink accepting layer-forming coating liquid to the white layer.

16. The method of manufacturing a decorative illumination recording sheet according to claim 14, wherein the forming of the white layer includes the adjusting of Tv and Tr within a range satisfying the relationships expressed by Formulae (1) and (2), and wherein, in the forming of the white layer by applying a white layer-forming coating liquid containing a white pigment and a binder to at least one side of a resin base, a white layer-forming coating liquid containing a white pigment, a binder, and a colorant different from the white pigment is applied to form the white layer, and thus Tv and Tr of the decorative illumination recording sheet are adjusted within a range satisfying the relationships expressed by Formulae (1) and (2).

* * * * *